US009682004B2

(12) United States Patent
Schmitt et al.

(10) Patent No.: US 9,682,004 B2
(45) Date of Patent: Jun. 20, 2017

(54) SYSTEMS, DEVICES AND METHODS FOR EXERCISING THE LOWER LIMBS

(71) Applicant: LAMBDA HEALTH SYSTEM SA, Yverdon-les-Bains (CH)

(72) Inventors: Carl Schmitt, Yverdon-les-Bains (CH); Aurelien Fauquex, Lausanne (CH)

(73) Assignee: LAMBDA HEALTH SYSTEM SA, Yverdon-les-Bains (CH)

( * ) Notice: Subject to any disclaimer, the term of this patent is extended or adjusted under 35 U.S.C. 154(b) by 0 days.

(21) Appl. No.: 14/905,330

(22) PCT Filed: Jul. 19, 2013

(86) PCT No.: PCT/EP2013/065366
§ 371 (c)(1),
(2) Date: Jan. 15, 2016

(87) PCT Pub. No.: WO2015/007349
PCT Pub. Date: Jan. 22, 2015

(65) Prior Publication Data
US 2016/0158086 A1 Jun. 9, 2016

(51) Int. Cl.
*A61H 1/00* (2006.01)
*A61H 1/02* (2006.01)

(52) U.S. Cl.
CPC ..... *A61H 1/0266* (2013.01); *A61H 1/0237* (2013.01); *A61H 1/0255* (2013.01);
(Continued)

(58) Field of Classification Search
CPC .. A61H 1/0266; A61H 1/0255; A61H 1/0237; A61H 2201/1671; A61H 2201/1664; A61H 2201/164
See application file for complete search history.

(56) References Cited

U.S. PATENT DOCUMENTS 4,637,379 A * 1/1987 Saringer ..... A61H 1/0259 601/34
4,665,899 A * 5/1987 Farris ..... A61H 1/0259 601/33

(Continued)

FOREIGN PATENT DOCUMENTS

EP 1387712 11/2005
WO 94/15571 7/1994

OTHER PUBLICATIONS

Bouri, M., et al., "A New Concept of Parallel Robot for Rehabilitation and Fitness: The Lambda", Proceedings of the 2009 IEEE International Conference on Robotics and Biomimetics (2009) 2503-2508.

(Continued)

*Primary Examiner* — Justine Yu
*Assistant Examiner* — Timothy Stanis
(74) *Attorney, Agent, or Firm* — Robert C. Netter, Jr.; Dann, Dorfman, Herrell & Skillman

(57) ABSTRACT

The present invention relates to devices and methods for exercising the lower limbs, in particular for exercising lower limbs. The devices are suitable for training the lower limbs of persons suffering from paraplegia or hemiplegia or musculoskeletal disorders in general. In some aspects, the present invention relates to powered articulated systems (ASs) and to the rehabilitation by aid of said ASs. The parallel or hybrid ASs of the invention are based on a parallel or hybrid, lambda-type framework and are controlled by a data processing unit. The ASs are preferably controlled by a closed-loop, real time control system.

20 Claims, 16 Drawing Sheets

(52) U.S. Cl.
CPC ..... *A61H 2201/0176* (2013.01); *A61H 2201/1215* (2013.01); *A61H 2201/149* (2013.01); *A61H 2201/164* (2013.01); *A61H 2201/1659* (2013.01); *A61H 2201/1664* (2013.01); *A61H 2201/1671* (2013.01); *A61H 2201/1676* (2013.01); *A61H 2201/5035* (2013.01); *A61H 2201/5061* (2013.01); *A61H 2201/5064* (2013.01); *A61H 2201/5069* (2013.01); *A61H 2203/0437* (2013.01)

(56) References Cited

U.S. PATENT DOCUMENTS

| | | | | |
|---|---|---|---|---|
| 5,399,147 | A * | 3/1995 | Kaiser | A61H 1/0255 601/16 |
| 6,217,532 | B1 * | 4/2001 | Blanchard | A61H 1/024 601/23 |
| 2004/0003468 | A1 * | 1/2004 | Mitsuishi | A61H 1/0237 5/624 |
| 2004/0172097 | A1 * | 9/2004 | Brodard | A61H 1/0255 607/49 |
| 2006/0064044 | A1 | 3/2006 | Schmehl | |
| 2010/0036302 | A1 * | 2/2010 | Shimada | A61F 5/0102 602/16 |
| 2011/0040215 | A1 * | 2/2011 | Knoll | A61H 1/0255 601/34 |
| 2011/0256983 | A1 * | 10/2011 | Malack | A61H 1/0266 482/4 |
| 2012/0101414 | A1 | 4/2012 | Hesse et al. | |

OTHER PUBLICATIONS

Métrailler, Patrick, "Système Robotique Pour La Mobilisation Des Membres Inférieurs D'Une Personne Paraplégique," Doctoral Thesis, École Polytechnique Fédérale De Lausanne, 2005.

Schmitt, Carl, "Orthèses fonctionnelles à cinématique parallèle et sérielle pour la rééducation des membres inférieurs," Doctoral Thesis, École Polytechnique Fédérale De Lausanne, 2007.

Stauffer, Yves, "Control Strategies for a Verticalized Rehabilitation Robot," Doctoral Thesis, École Polytechnique Fédérale De Lausanne, 2009.

* cited by examiner

SYSTEMS, DEVICES AND METHODS FOR EXERCISING THE LOWER LIMBS

This application is a §371 application of PCT/EP2013/065366, filed Jul. 19, 2013. The entire disclosure of the foregoing application is incorporated by reference herein.

TECHNICAL FIELD

In general, the present invention relates to systems, devices and methods for exercising the limbs, in particular for exercising lower limbs. In some aspects, the present invention relates to powered orthoses and to the rehabilitation by aid of said orthoses. The present invention relates to devices comprising articulated systems and/or an articulated lambda-framework for exercising. The present invention further relates to orthopedic systems devices equipped with motors and captors, to motorized devices for training the lower limbs of a subject, and to methods for controlling or driving the orthoses, systems, devices and methods of the invention.

PRIOR ART AND THE PROBLEM UNDERLYING THE INVENTION

Robotics applied to rehabilitation requires specific manipulators: Powered Orthoses. They are orthopedic devices equipped with motors and captors that enable locomotor assistance. Powered orthoses must be capable of reproducing physiological articular trajectories and taking over or simulating the segmentary charges of a movement, mainly walking. One needs to obtain rather high dynamic performances with the help of small activators enabling mechanical integration bearable for its subject.

Previously developed, powered orthoses for re-education of the lower limbs are generally serial, exoskeleton-based structures, such as the MOTIONMAKER™. These devices are based on an exoskeleton fixed along the lower limbs of an individual, wherein a series of actuating motors cause movement of the exoskeleton and of the limbs attached thereto. An example of a serial, hip-knee-ankle exoskeleton-based device is disclosed in EP 1 387 712. These devices have several disadvantages. They are generally not capable of rapid movement and the motors have limited strengths, because motor size is limited as the motors are fixed on the moving exoskeleton. A further disadvantage is that for small persons, such as children, a separate, smaller device is necessary, as adjustment to anatomical particulars is only possible within relatively narrow limits. Furthermore, such devices take a lot of space, even when they are not used. Finally, it would be advantageous to provide devices suitable for re-education not only of patients suffering from paralysis, such as paraplegia and tetraplegia, but also for training healthy people and/or only partially paralyzed patients, retaining some musculoskeletal function in the lower limbs.

In the thesis no. 3783 of Carl Schmitt (2007) entitled "Orthèses fonctionnelles à cinématique parallèle et sérielle pour la rééducation des membres inférieures" (2007) at the École Polytechnique Fédérale de Lausanne, parallel powered orthoses having a λ-structure are proposed. The publication of M. Bouri et al. entitled "A new concept of parallel robot for rehabilitation and fitness: The Lambda" of the Proceedings of the 2009 IEEE International Conference on Robotics and Biomimetics, Dec. 19-23, 2009 discloses a λ-robot for rehabilitation and fitness. However, these prior art devices suffer from several disadvantages: they are relatively noisy; they are too big, heavy and are built from too many parts. The prior art devices generally use a spring for compensating gravity.

The present invention addresses the problems depicted above and seeks to provide improved devices for rehabilitation and/or for exercising lower limbs.

The present invention seeks to provide a device suitable for re-educating and/or training the lower limbs of a person, in particular a person having an impairment of the central nervous system, such as a patient suffering from tetraplegia, paraplegia and/or hemiplegia. The invention seeks in particular to provide a device that can be used to train the limbs of a large population of subjects suffering from various conditions, for geriatric subjects and also a device that can be used for wellness purposes by healthy subjects.

SUMMARY OF INVENTION

In an aspect, the present invention concerns a motorized device and/or a robot for training the lower limbs of a subject, the device comprising a pair of articulated systems and/or orthoses, intended to form an interface with said subject, wherein each of said articulated systems comprises a base, a foot support assembly and a framework for said foot support assembly.

In an aspect, the present invention concerns a device for re-educating and/or training the lower limbs of a person, in particular a person having an impairment of the central nervous system, wherein the device comprises a pair of articulated systems and/or orthoses, each orthose comprising a lambda-framework structure for positioning and/or moving a foot support assembly.

In an aspect, the present invention concerns a device for re-educating and/or training the lower limbs of a person, in particular a person having an impairment of the central nervous system, wherein the device comprises a pair of articulated systems (ASs).

In an aspect, the present invention concerns a motorized device for training the lower limbs of a subject, the device comprising a pair of articulated systems (ASs), intended to form an interface with said subject, wherein each of said articulated systems comprises a foot support assembly comprising a Tool Operation Center (TOC) pivotally fixed on an articulated lambda framework (ALF), wherein: said ALF is pivotally connected to at least two carts, a first cart guided on a first rail track section and a second cart guided on a second rail track section; wherein said device comprises a first driving screw and a second driving screw for driving said first and second carts, respectively, and wherein said first and second driving screws are independently driven by a first motor and a second motor, respectively; wherein a position of said TOC within a plane is determined by positions of said sliding carts on their respective rail track sections; wherein the device further comprises a transmission assembly, for transmitting a rotational movement driven by a third motor to said TOC; and, wherein said third motor is fixed on said first sliding cart.

In an aspect, the present invention provides a motorized device for training the lower limbs of a subject, the device comprising a pair of articulated systems, intended to form an interface with said subject, wherein each of said articulated systems comprises a base, a foot support assembly and a framework for said foot support assembly, wherein: said framework comprises two longitudinal, articulated subassemblies, a main subassembly and a supporting subassembly, wherein, at one extremity, said main subassembly is pivotally connected to a first cart articulation, and with the other extremity it is connected to said foot support assembly, wherein said supporting subassembly is pivotally connected at one extremity to a second cart articulation and with the other extremity to said main subassembly; said base comprises a support or carrier structure on which two rail track sections, a first rail track section and a second rail track section are fixed, wherein a first cart is guided on said first rail track section and a second cart is guided on said second rail track section; said base further comprises a first driving screw and a second driving screw, wherein said first driving screw is arranged to drive said first cart and said second driving screw is arranged to drive said second cart; a first motor is arranged to rotate said first driving screw and a second motor is arranged to rotate said second driving screw, wherein rotation of said first and second driving screws results in linear movement of said first and second cart, respectively; a third motor is fixed on said first cart, adapted to act on a transmission assembly, wherein said transmission assembly is adapted to transmit a rotational movement of said third motor to a foot contact assembly, wherein said foot contact assembly is pivotally connected with said foot support assembly.

In an aspect, the invention further relates to a carrying system for carrying the device of the invention, and/or a carrying system comprising the device of the invention.

In an aspect, the invention relates to methods of running the device of the invention. The invention also relates to methods of training and/or exercising using the device of the invention.

Further aspects and preferred embodiments of the invention are defined herein below and in the appended claims. Further features and advantages of the invention will become apparent to the skilled person from the description of the preferred embodiments given below.

Hereinafter, preferred embodiments of the device and system of the invention are described with reference to the drawings.

DETAILED DESCRIPTION OF THE PREFERRED EMBODIMENTS

The present invention provides a motorized system, device and/or a robot for training the lower limbs of a subject. In preferred embodiments, the device comprises a motorized mechanical device and a control system for operating the device.

For the purpose of the present specification, the expression "comprise", "comprising" or its various grammatical forms is intended to mean "include, amongst other". It is not intended to mean "consists only of".

FIGS. 1 to 18 show an embodiment of the mechanical parts and electronic components directly fixed on the mechanical parts of a device 1 according to an embodiment of the invention. The mechanical parts comprise structural components and articulations, and the electronic components comprise motors and sensors, for driving the mechanical parts of the device and for providing feedback control input of the device during operation. FIG. 19 schematically illustrates schematically the interaction between the control system and the electronic components of the device 1.

Figure 1:
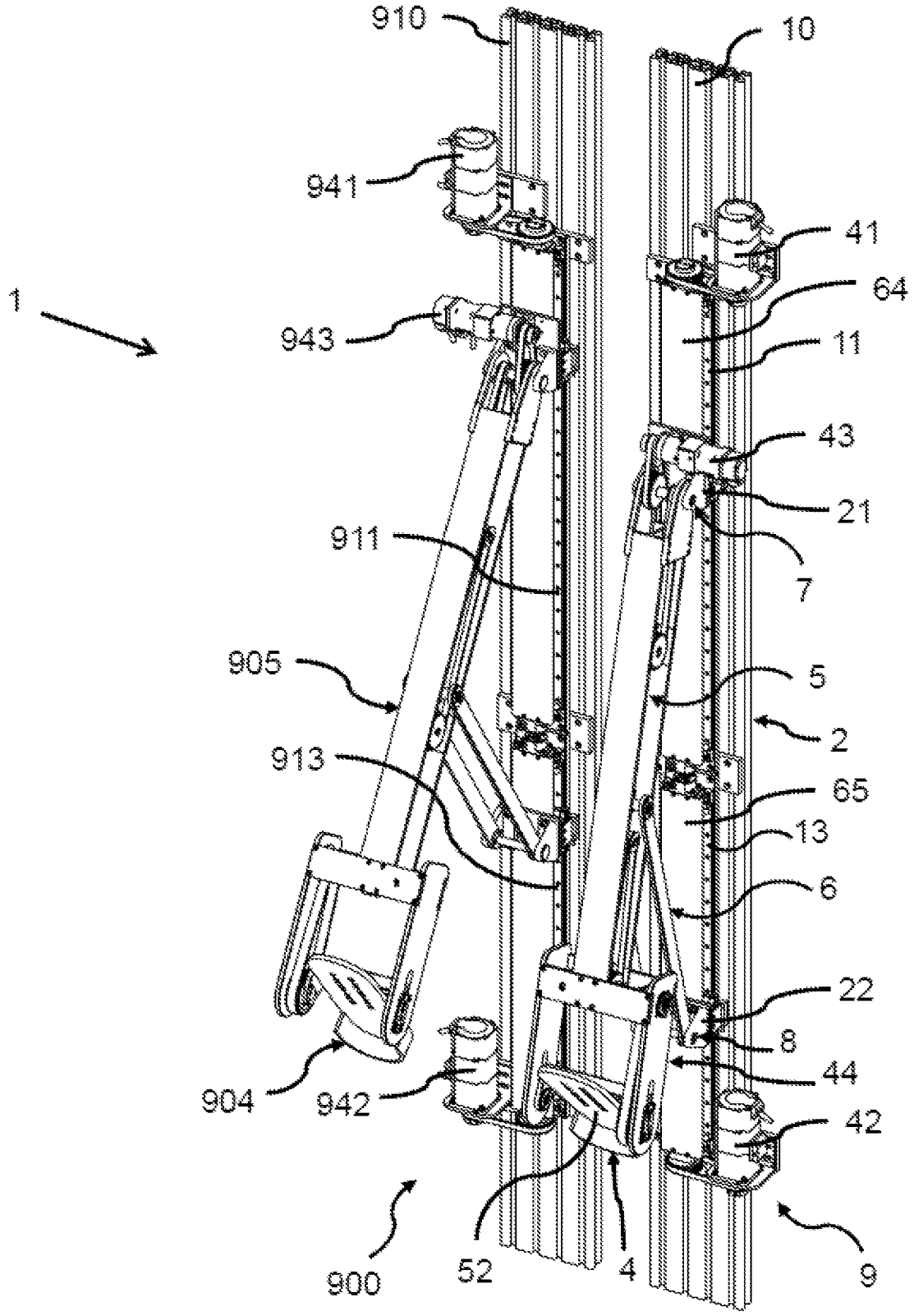
FIG. 1 shows an embodiment of the motorized, articulated device of the present invention.
Figure 17:
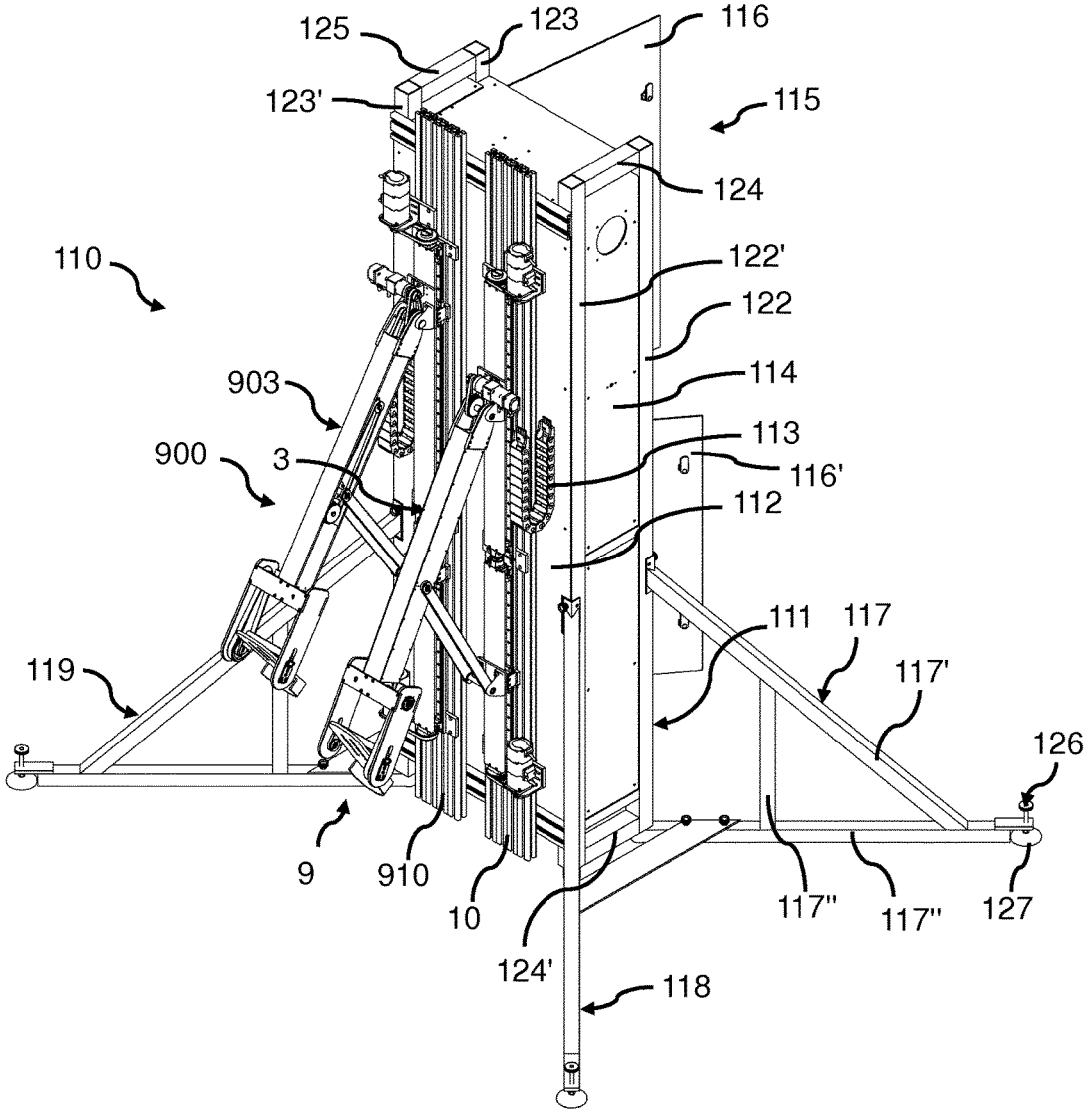
FIGS. 17 and 18 are perspective and rear elevation views, respectively, of a carrying system for the device shown in FIGS. 1-3.
Figure 18:
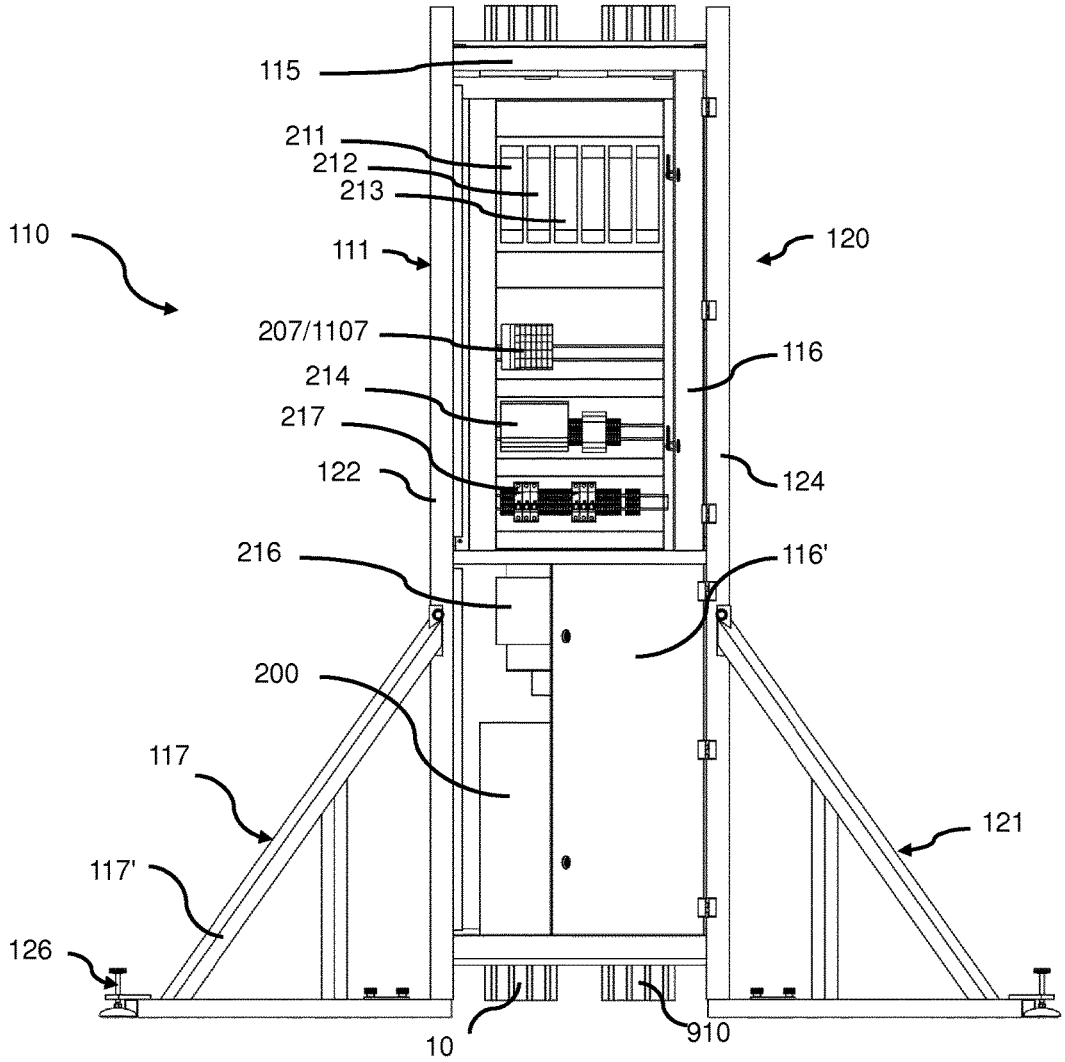
Figure 19:
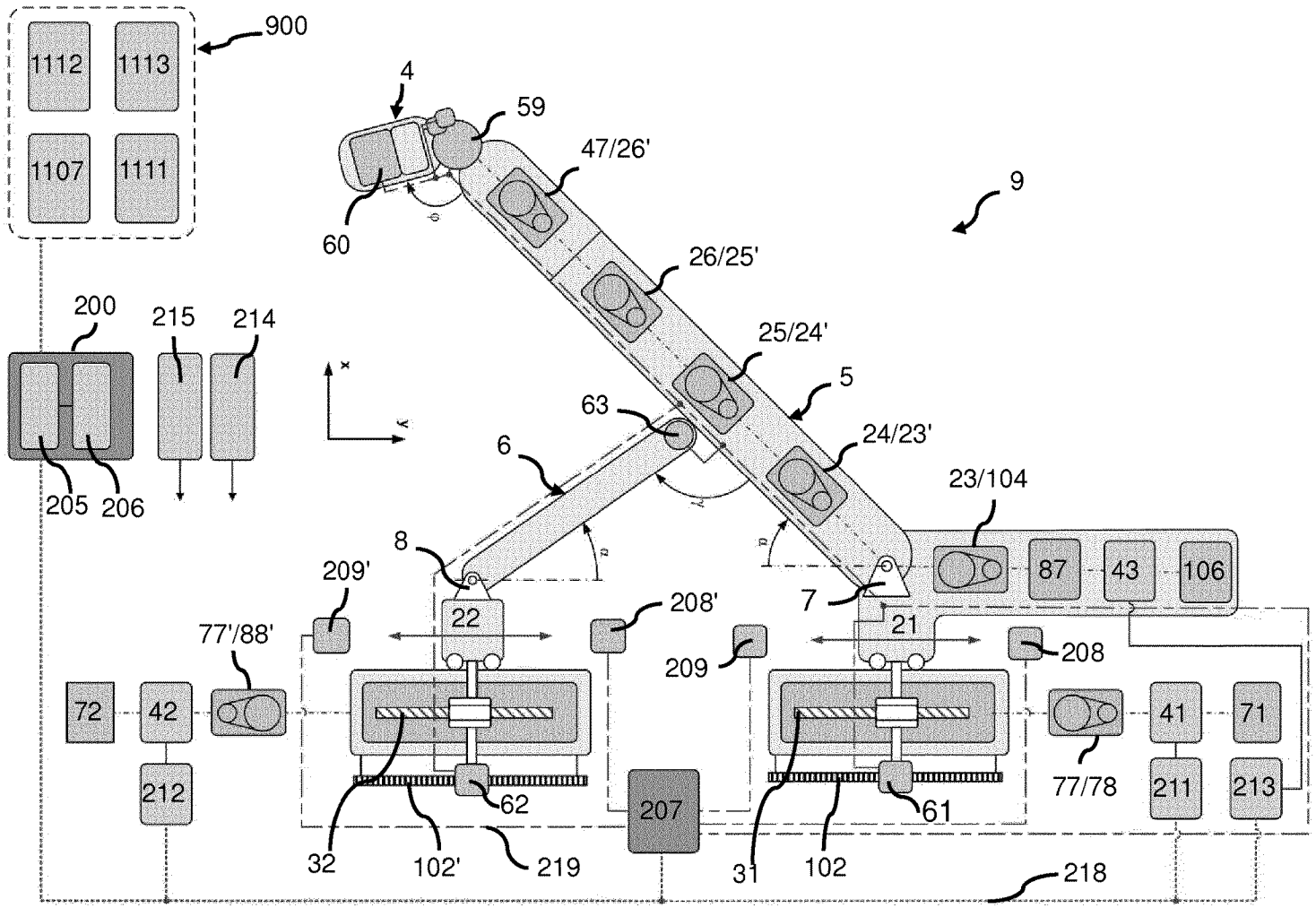
FIG. 19 is a schematic representation of an embodiment of the invention, including electric components.

In FIG. 1, a support or carrier structure 10, 910 of the device is vertically oriented, for example fixed on a wall or on a particular, mobile carrier system as shown in FIGS. 17 and 18. In FIG. 1, the device is thus shown in its vertical position. The device also can be put in a horizontal position (FIG. 2), for example on a ground surface, or in an inclined (FIG. 20) or total upside-down position, with the arms 3, 903 of the system extending downward from the support structure 10, 910. For example, the device of the invention could be fixed to a ceiling or to a mobile carrier framework illustrated schematically in FIG. 20.

As can be seen in FIG. 1, the device of the invention comprises two separate, articulated systems (ASs) 9, 900, a first AS 9 for interaction with the right foot of a subject, and a second AS 900 for interaction with the left foot of a subject. The ASs 9 and 900 shown could also be referred to as powered articulated arms (PARs), Lambda Robotic Arms (LRAs), due to the lambda-like appearance of the AS, or more generally robotic arms (RAs). Also the expressions "orthoses" and "manipulators" may be used to refer to the AS of the device of the invention. These expressions are considered as equivalents and may be interchangeably used in the present specifications.

According an embodiment of the invention, the AS of the invention comprises a parallel architecture and/or geometry. For example, the device of the invention comprises a parallel robotic architecture. According to a preferred embodiment, the device of the invention comprises a parallel and serial (hybrid) architecture and/or geometry. For example, the device comprises a hybrid robotic architecture. Accordingly, the device of the invention comprises preferably a parallel or hybrid manipulator.

Instead of first and second ASs, one could also refer to left and right articulated systems 900, 9. Said first and second ASs are preferably substantially identical or symmetrical with respect to a plane extending vertically (in FIG. 1), midway between ASs 9 and 900. According to an embodiment, the first AS is the mirror image of the second AS, for example as shown in FIG. 1. According to another embodiment, the first AS is not the mirror image of the second AS. In particular, some structural elements may or have to be arranged as mirror images, while the position of other structural elements of the device may depart from a completely mirrored construction. For example, while the articulated framework 3 including the foot support assembly 4 of the two ASs are preferably constructed as mirror images of each other, the position of the motors 41, 941; 42, 942, and 43, 943, of the two ASs, for example, may well be different from a perfect mirror-like construction. For example, the airs of motors 41, 941, etc, may be identically oriented, for example may both be fixed on the same side (e.g. the right side) of the rails.

According to an embodiment, said first and second ASs are identical. According to an embodiment, said first and second ASs comprise identical structural components. According to an embodiment, said first and second ASs function essentially in the same way.

Hereinafter, only the right or first AS 9 will be described in more detail, as the second or left AS 900 is basically constructed as a mirror image of the first AS 9. The structures described herein with respect to the first AS 9 are also present in the second AS 900, and what is said herein below with respect to the first AS 9 also applies, independently, to the second AS 900. Regarding the reference numerals, it is noted that each structural element of the second AS corresponds to the reference numeral of the left AS+900. For example, the food support assemblies of the first and second ASs have reference numerals 4 and 904, respectively. For easier understanding, the reference numerals of the second AS are not consequently shown in the figures and are not separately described herein below.

Figure 2:
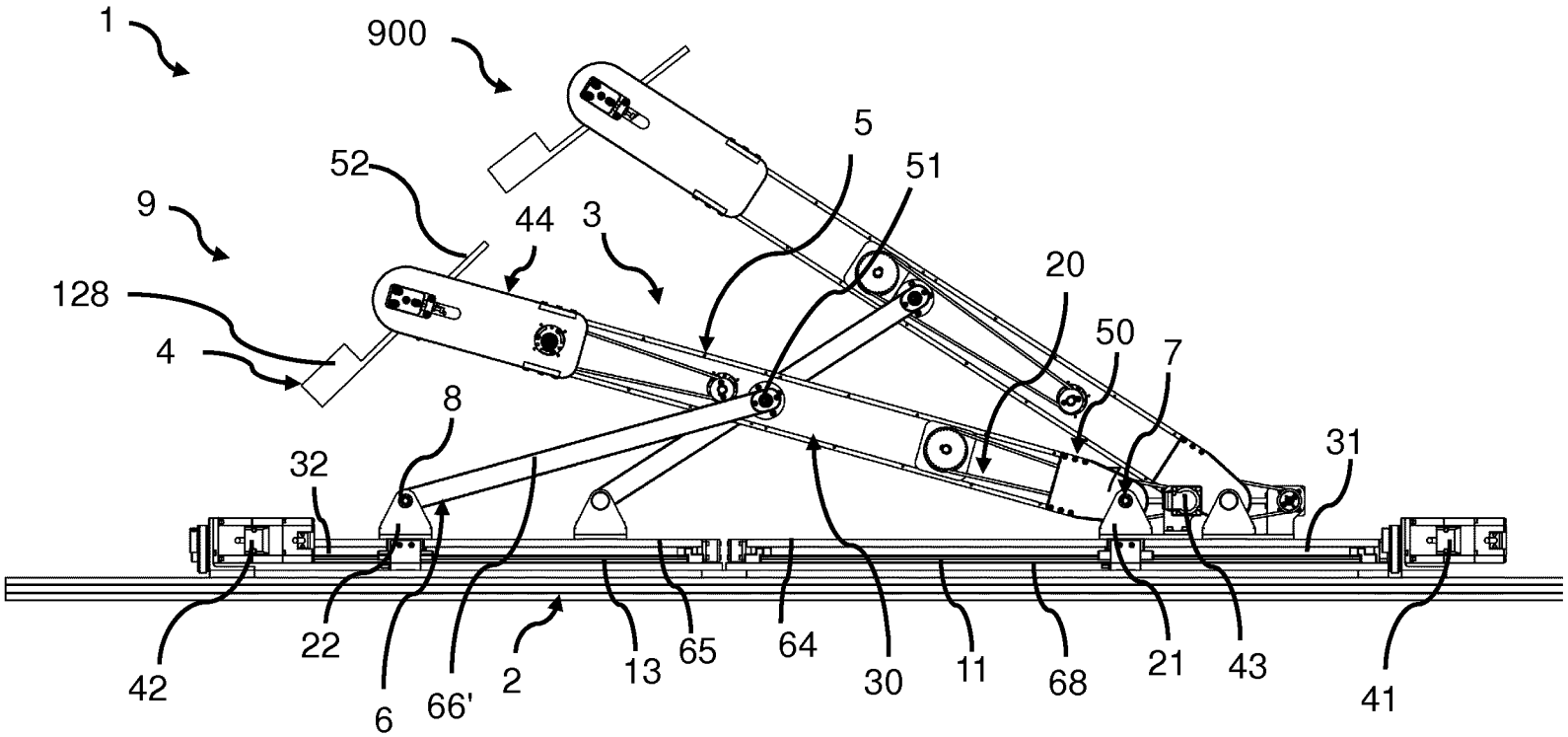
FIG. 2 is a side view to the articulated device of the embodiment shown in FIG. 1 in a horizontal position.

As can be seen in FIGS. 1 and 2, each of said articulated systems 9, 900 comprises a base 2, a foot support assembly 4, and a framework 3, which is generally referred to herein as framework assembly or Articulated Lambda Framework (ALF) 3, which carrying said foot support assembly 4. The framework assembly 3 is formed by the framework subassemblies 5 and 6, as described elsewhere in this specification.

Each base 2 preferably comprises a support and/or carrier structure 10 on which structural elements are fixed, such as rails, motors, cable hangers, screw fixations and drives or gear boxes from the motors to the drive screw are fixed, for example. The support structure 10 preferably provides a surface for fixing the AS 9. The support structure 10 may comprise profiles made from a rigid material, such as a metal, preferably selected from aluminum or steal, for example. Preferably, the support structure provides or comprises a surface extending in a plane on which the AS can be fixed.

Figure 3:
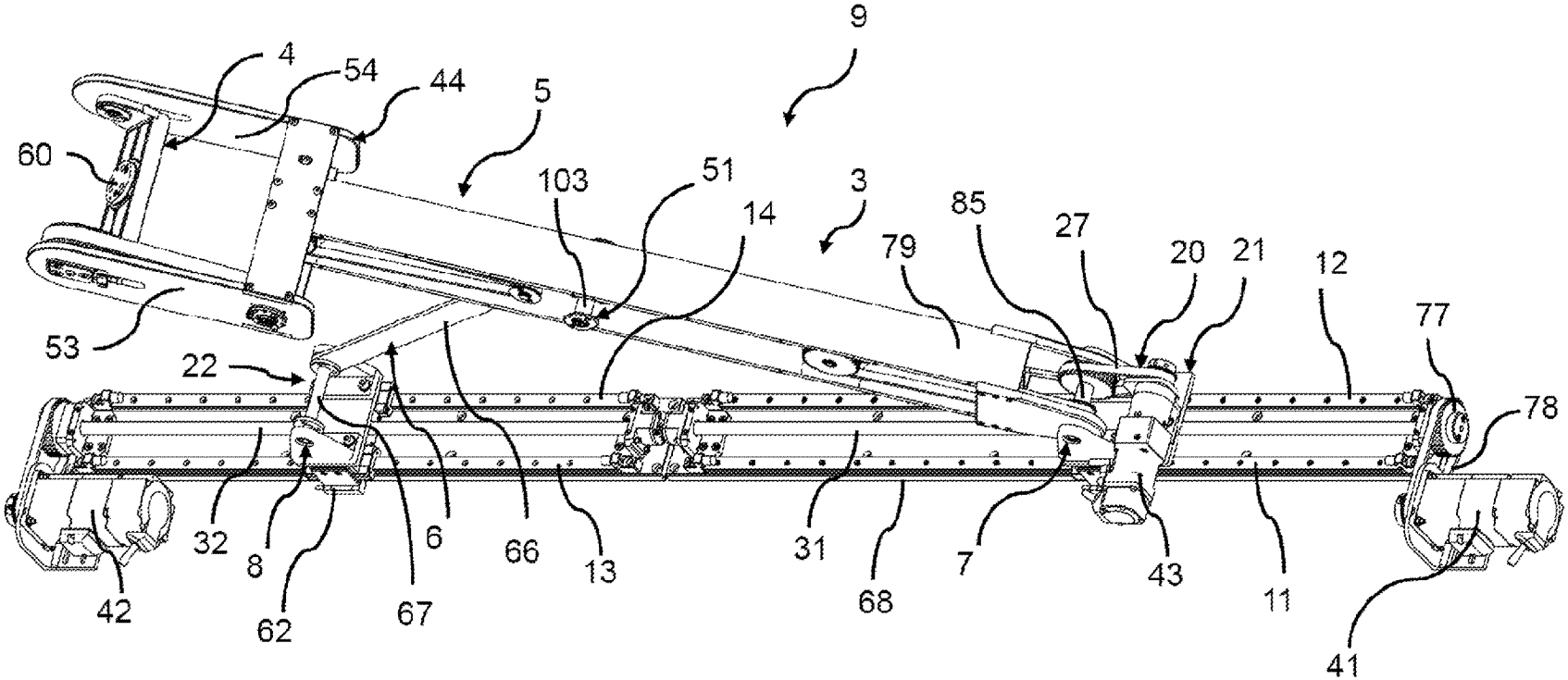
FIG. 3 shows in more detail one of the two articulated systems of the embodiment shown in FIG. 1, with certain structural parts being removed for better visibility.

Each base 2 further preferably comprises two rail tracks or two rail track sections. In the embodiment shown in the figures, each rail track comprises a pair of rails. In particular, the right base 2 comprises a first rail track comprising a first pair of rails 11, 12, and a second rail track comprising a second pair of rails 13, 14. In FIG. 1, protective covers 64, 65, are provided on each pair of rails, hiding the view to the left rails 12, 14. In the lateral front view of FIG. 2, the right rails 11 and 13 of the right AS 9 are visible, whereas all the other rails are not visible, being hidden by the visible rails. In FIG. 3, several parts have been removed in order to disclose the components of the base 2. In particular, the support structure 10 and the covers 64, 65 are removed in FIG. 3, so that the two pairs of rails 11, 12, and 13, 14 of the right AS 9 are clearly visible.

Said first rail track is preferably arranged in the same direction as the second rail track. Said first pair of rails 11, 12 is preferably oriented in the same direction as the second pair of rails 13, 14. According to an embodiment, said first and second pairs or rails are in the same plane.

According to an embodiment, said first and second pair of rails of AS 9 are coaxial and/or collinear. More specifically, a first rail 11 of said first pair of rails is collinear with a first rail 13 of said second pair of rails, and/or a second rail 12 of said first pair of rails is collinear with a second rail 14 of said second pair of rails. Preferably, one pair of rails is provided behind and/or as a prolongation of the first pair of rails.

In the figures, an AS comprising two pairs of collinear rails 11, 12 and 13, 14 is shown. The term "collinear" for the purpose of the present specification, means that a rail (e.g. rail 14) of the second pair of rails is the linear prolongation of a rail (here: rail 12) of the first pair of rails.

The term "coaxial" for the purpose of the present specification, means that a common axis of the first rail track section or first pair of rails together is the same as the axis of the second rail track section and or second pair of rails. The "axis" of a pair of rails extends at an equal distance between the two rails. As a consequence, the two driving screws 31 and 32 of the two coaxial pairs of rails are preferably coaxial, too.

It is noted that the invention encompasses various alternative constructions of the two rail tracks or rail track sections. For example, the invention encompasses that the two rail track sections are constructed as one single pair of rails, with the two sliding carts 21 and 22 being positioned on different sections of a single pair of rails. For example, collinear rails 12 and 14 may be formed by one single, continuous rail, and collinear rails 11 and 13 may be formed by another single, continuous rail. In this embodiment, the first sliding cart 21 can be said to be moved on a first rail track section 11/12, and the second sliding cart 22 is moved on a second rail track section 13/14.

According to another embodiment, there are two separate rail tracks and/or two pairs of rails, but they are not necessarily collinear. For example, while the first and second pairs of rails are preferably parallel, each pair of rail may comprise a different rail-to-rail distances. For example, the distance between rails 11 and 12 may be different from the distance between rails 13 and 14. For example, the distance between the rails 11 and 12 may be larger or smaller than the distance between rails 13 and 14. Since the distance between the rails may have an impact on the stability, the variation of the distance can be used as a possibility to adjust and/or optimize the stability of the ALF with respect to other constraints, such as spatial considerations, for example.

According to another embodiment, the two rail tracks and/or the two pairs of rails 11, 12 and 13, 14 extend in parallel, laterally displaced one section with respect to the other.

According to another embodiment, the two rail tracks and/or the two pairs of rails 11, 12 and 13, 14 are displaced with respect to the plane in which they are situated. For example, one of the two rail tracks may be elevated with respect to the other rail track. For example, one rail track may be closer to the base and the other more distanced or elevated with respect to the base plane.

According to a still further embodiment, the two rail tracks and/or the two pairs of rails 11, 12 and 13, 14, respectively, do not even extend in parallel, but extend at an angle with respect to each other. In this embodiment, the two rail tracks resemble the two edges of an obtuse triangle, for example.

The constructional and/or architectural variations depicted above are just examples. Such variations may help increase the stability of the ASs and or of the entire device of the invention, for example, during operation.

On each rail track or rail track section, a sliding cart is provided, arranged to move on the rail track. A first car 21 is provided on the first rail track 11, 12, and a second cart 22 is provided on a second rail track 13, 14. Said first and second sliding cars are preferably arranged to move, independently, in the same two opposing directions on their respective rail tracks.

The first and second sliding carts 21, 22 are preferably driven independently by a first driving screw 31 and a second driving screw 32. In FIG. 1, the driving screws are hidden by the first and second protective covers 64 and 65, respectively, but they are visible in FIG. 3. It is noted that the external threading of the driving screws 31, 32 is not shown, and the driving screws thus appear as smooth shafts on all figures except FIG. 19, where the threading is schematically shown, and FIGS. 20 and 21, where the driving screws are not shown. The driving screws 31, 32 and the sliding carts 21, 22 can be considered to be part of the base, as well as the driving motors 41, 42, which are arranged to drive the rotation of the driving screws.

According to an embodiment, said first and second driving screws 31, 32, comprise at least a multiple thread screw. Preferably, the first and second driving screws comprise at least a triple—more preferably at least a quadruple thread screw. Preferably, said driving screw comprises a multiple outer thread screw. The expression "multiple thread screw", for example "quadruple thread screw" encompasses in particular multiple-start threads, such as quadruple-start screws.

In particular, a first motor 41 is arranged to rotate said first driving screw 31 and a second motor 42 is arranged to rotate said second driving screw 32, wherein rotation of said first and second driving screws results in linear movement of said first and second cart, respectively. In the embodiment shown in FIG. 1, the first motor 41 is provided at one extremity of the first rail track 11/12 and the second motor 42 at one extremity of the second rail track 13/14. Preferably, said first and second motors 41, 42 are arranged on opposing extremities of said first and second rail tracks. In FIG. 1, the motors 41 and 42 are shown on the top and on the bottom of the device.

The device of the invention comprises a framework 3 comprising two subassemblies, a first or main subassembly 5, and a second or supporting subassembly 6. Preferably, said main and support subassemblies 5, 6 are each longitudinal. Preferably, said main subassembly 5 is longer and larger than said support subassembly 6. The support subassembly 6 comprises two extremities wherein at one of said two extremities said support assembly is pivotally connected to said main subassembly 5, and at said other or second extremity it is connected to said second sliding cart 22. Instead of main subassembly 5, the expression "main longitudinal assembly", "main longitudinal structure" or simply "main beam" may be used for the purpose of this specification. Instead of support subassembly 6, the expression "support longitudinal assembly", "support longitudinal structure" or simply "support beam" may be used for the purpose of this specification.

The subassemblies 5 and 6 are pivotally connected to each other at a pivotal connection 51. With respect to the main subassembly 6, the pivotal connection 51 may be located closer to the center than to one of the extremities of the main subassembly, as shown in FIG. 2 (also central ALF in FIG. 21). Said pivotal connection preferably comprises a bearing assembly 51, preferably two ball bearings. Preferably, an axle of said support subassembly is rotably guided in said ball bearings. According to an embodiment, said support subassembly 6 is rotatably and/or pivotally connected to said main subassembly 5 at said bearing assembly 51.

When viewed from lateral, as shown in FIG. 2 (see also center of FIG. 21), the framework 3 formed by said main and support subassemblies 5 and 6, respectively, looks like the Greek letter lambda (λ), which is why these subassemblies as a whole are also referred to as the "λ-structure", "λ-framework", and/or "Articulated Lambda Framework" (ALF) 3 for the purpose of this specification. In this regard, the main subassembly 5 corresponds to the main or longer line in the letterλ, while the support subassembly 6 corresponds to the short line in the letter λ. Furthermore, the entire device of the invention is also referred to as "Lambda Orthose" "Lambda Articulated System " or "Lambda Health System". The lambda structure formed by subassemblies 5 and 6 is at the origin and/or forms the key structure for guiding the movement of the AS of the present invention. The λ-framework becomes in particular apparent when the base 2 is oriented in a horizontal position as shown in FIG. 2.

At their extremities, the main and support subassemblies 5 and 6, respectively, are pivotally connected to the first and second sliding carts 21, 22. In FIG. 2, these are the proximal extremities of said main and support subassemblies, that is, the extremities that are closer to the base 2. The distal extremity 44 of the main longitudinal subassembly 5 is the extremity that is closer to the foot support assembly 4. At its proximal extremity, the main subassembly is pivotally connected to a first cart articulation 7. The proximal extremity of the support subassembly 6 is pivotally connected to a second cart articulation 8. Said first and second cart articulations 7 and 8 preferably each comprise a pair of ball bearings and axles being rotatably guided in said ball bearings.

For the purpose of the present specification, the term "proximal" generally means closer to the base 2 of the device of the invention, and "distal" generally means further away from the base. The foot support assembly 4 is thus provided at the distal end of the main framework assembly 5. In this specification, these terms are thus generally used with reference to the device as such and not with respect to the subject using the device. When seen with respect to the user/subject, the most proximal part of the device of the invention would be the foot support assembly 4. In this situation, the expressions "proximal" and "distal" will be used specifically with respect to or with reference to the subject.

It is noted that the foot contact assembly 4, and more specifically the foot contact plate 52 of assembly 4 forms the Tool Operation Center (TOC), which is the place where the function of the device of the invention is achieved or fulfilled and/or, which is the place of the interface between the subject and the device of the invention for the purpose of exercising.

Therefore, for the purpose of this specification, the expression "TOC" refers to the foot support assembly 4 and more specifically to the foot contact plate 52.

Figure 21:
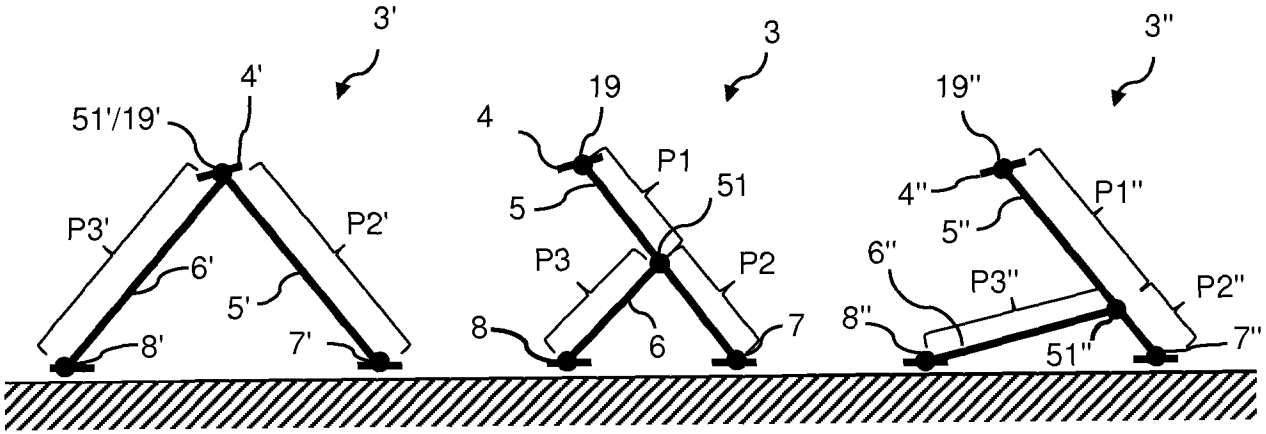
FIG. 21 is a schematic representation of different λ-framework structures in accordance with different embodiments of the invention.

The present invention encompasses different λ-type or λ-derived geometries, as illustrated in FIG. 21. In FIG. 21, three different general geometric arrangements of the articulated framework and or the AS of the invention are shown. These geometries differ in particular with respect to the position of the central articulation 51 (51', 51") where the main and support subassemblies 3 and 5 are pivotally connected to each other, and/or with respect to lengths P1, P2 and P3, which is related to the position of (51', 51").

The AS 3 in the middle of FIG. 21 illustrates the λ-geometry of the device shown in FIGS. 1-3, for example. The articulation 51 is provided halfway from the first cart articulation 7 and the articulation 19 of the foot support assembly 4. Therefore, geometrically, the main longitudinal subassembly 5 is divided in two equal sections P1 and P2. The section P3 is the geometric length of the support longitudinal subassembly 6. In this embodiment, P1, P2 and P3 are equal (P1=P2=P3) or close to equal (P1≈P2≈P3) in length. The geometric length of the main subassembly 5 is twice the geometric length of the support subassembly 6. This embodiment represents an isoscele lambda. For example, the length of P2 and P3 are both ±20%, preferably ±10% of the length of P1. This is a preferred embodiment of the invention.

It is noted that the expression "geometric length" refers to geometrically or physically relevant lengths, in particular lengths between articulations. These lengths are relevant with respect to the calculation and computation of the movements of the AS and also for the adjustment of the AS to the parameters of a subject using the device of an invention, as described elsewhere in this specification. In FIG. 21, P1, P2, P3; P2', P3'; and P1", P2" and P3" represent geometric lengths. The geometric length of the main longitudinal subassembly 5 (P1+P2) is the length on a straight line between the first cart articulation 7 and the foot support articulation axis 19 (see also FIG. 16). P2 is the geometric length between the first cart articulation 7 and the articulation 51 (51', 51"). P3 is the geometric length of the support longitudinal subassembly 6, which extends from the second cart articulation 8 (8', 8") and the central articulation 51 (51', 51"). P1 is the geometric length between the central articulation 51 (51', 51") and the foot support articulation 19 (19', 19").

In the AS 3' shown on the left side on FIG. 21, the central articulation 51' has been placed close to the distal end of the main longitudinal subassembly 5' and thus close to the foot support assembly 4'. In the extreme case shown, the articulations 51' between the main and support longitudinal subassemblies 5' and 6' and the foot support articulation 19' are coaxial. There is no P1 (P1=0) as in the central embodiment of FIG. 21, which is why the geometry of AS 3' is similar to a triangle. In the embodiment shown, P3' and P2' are equal (P2'=P3') or close to equal (P'2≈P3') in length. For example, P2' is ±20%, preferably ±10% of the length of P3'. Also shown are the first and second cart articulations 7' and 8'.

In embodiment that can be seen as a variation of the embodiment shown on the left side of FIG. 21, P1 is >0, but P2' is larger than P1' (or P2' larger than P1'). In this embodiment, P3' is generally >P2'. Furthermore, P3'>P1'. In this case, the articulations 51' between the main and support longitudinal subassemblies 5' and 6' and the foot support articulation 19' are not coaxial as in the embodiment shown on the left side of FIG. 21, but the articulations are closer to each other than as shown in the central embodiment of FIG. 21.

Finally, the exemplary AS 3" shown on the right side in FIG. 21 represents a further embodiment of the geometry of the framework 3" of the invention, in which P2" is reduced compared to P1" and/or compared to P3". As the skilled person will note, the pivotal articulation 51" between the main and support longitudinal subassemblies 5" and 6" is situated closer (compared to AS 3) to the first cart articulation 7" and thus closer to the base on the main subassembly 5". Compared to AS 3, the pivotal articulation 51" is further away from the articulation 19" of the foot support 4". In other words, P2" is smaller than P1". In AS 3", P3" and P1" may be (but need not be) equal (P3"=P1") or close to equal (P3"≈P1") in length. For example, P3" is ±20%, preferably ±10% of the length of P1". Also shown is the second cart articulation 8".

As becomes clear from FIGS. 1 and 2, the position in a vertical plane of the foot support assembly 4, which is provided at the distal extremity 44 of the main subassembly 5 (the upper extremity in FIG. 2), is determined by the position of said first and second sliding carts 21, 22. The movement of said foot assembly 4 in a vertical plane is determined by the movement of said first and second carts. The movement or trajectory of the foot assembly 4 (as a whole) in dependence of time can be resolved mathematically as a function of the movement of said first and second carts 21 and 22.

The device of the invention comprises a foot assembly or foot support assembly 4, which comprises in particular a foot contact plate 52. The foot contact plate 52 comprises a surface or contact area for placing and/or fixing the foot or sole as described elsewhere in more detail. The foot contact plate 52 preferably represents the TOC as described elsewhere in this specification. The foot contact assembly 4 is pivotally connected to a distal extremity 44 of the main framework subassembly 5, and is thus capable of pivoting. The distal extremity 44 is actually an assembly for pivotally holding the foot contact assembly 4. The foot contact assembly 4 resembles and/or functions in a similar manner as a pedal or treadle, and may also be referred to as pedal in this specification. In the operating device, the pivoting of the foot contact assembly 4 allows determining the movement and/or rotation of the ankle articulation of a subject.

For operating the device of the invention, in particular for the purpose of training the limbs of a subject, the foot contact assembly 4 is moved in a vertical plane and/or rotated so as to design a specific trajectory defined by of a training exercise. To this end, motors are provided. A first motor 41 is provided to drive said first cart 21. A second motor 42 is provided to drive said second driving cart 22. A third motor 43 is provided to rotate and or pivot the foot contact assembly 4. The third motor 43 is preferably fixed on said first cart 21. Rotation of the motor axle of the third motor is preferably transmitted by way of a transmission assembly 20 to said foot contact assembly 4, as will be described in more detail elsewhere in this specification.

Figure 14:
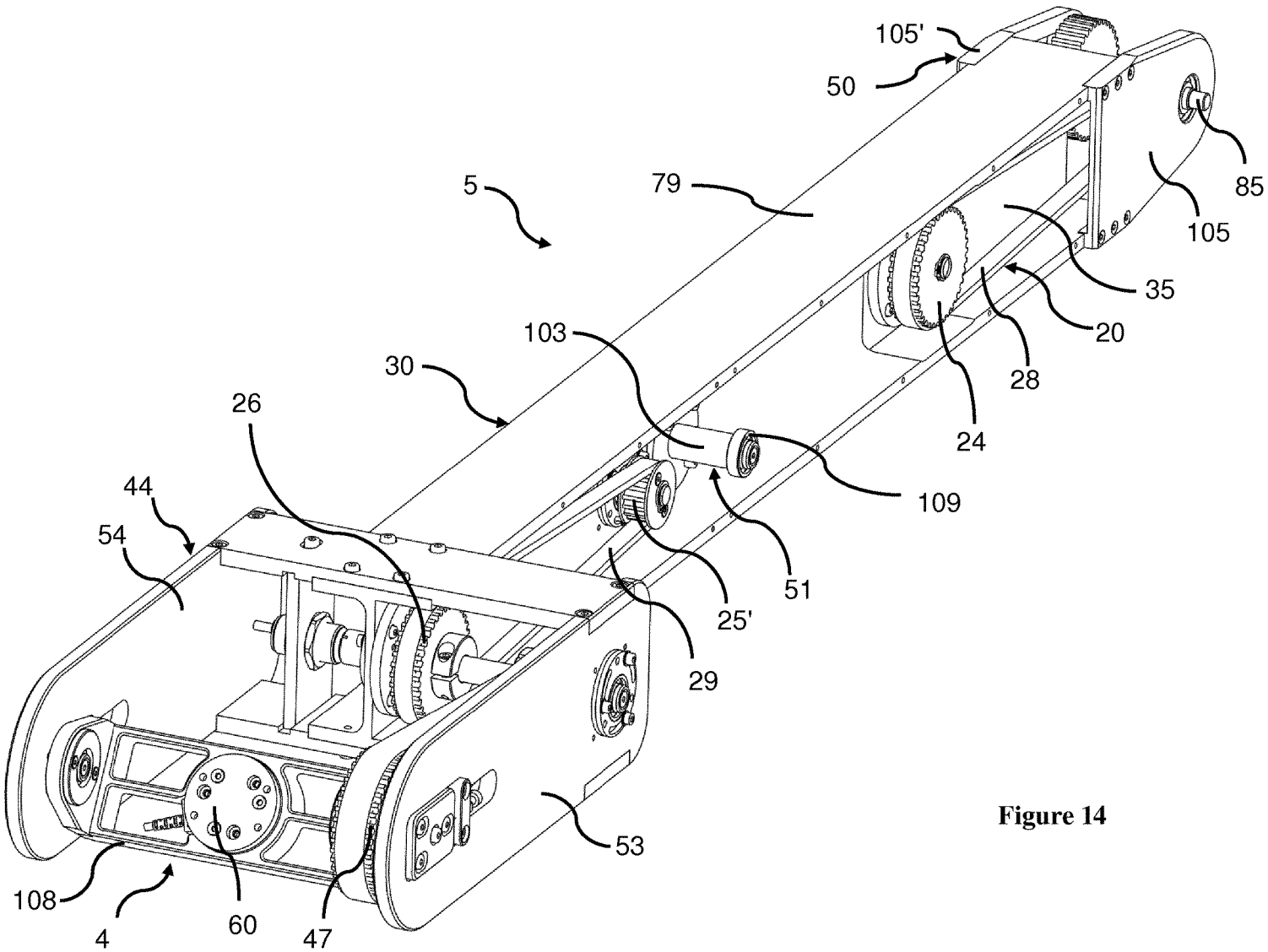
FIG. 14 is a perspective view of a partially demounted longitudinal framework subassembly of the device shown in FIGS. 1-3.

The support framework assembly 6 is connected via ball bearings to the two axles 67, 103. In FIG. 14, one ball bearing 109 is visible. The axles 67 and 103 and the ball bearings are part of the pivotal articulations 8 and 51, respectively, on the cart 22 and on the main framework subassembly 5. In the embodiment shown, the axles are pivotally harbored at the extremities of two lateral, longitudinal bars, profiles or plates 66, 66'. In particular, at both extremities of each bar 66, 66', there is a ball bearing, and the axles 67, 103 are pivotally locked in these ball bearings. The axles 67, 103 are thus pivotally connected to the two bars 66, 66' so that the latter extend substantially in parallel. In FIG. 3, one of said bars (bar 66') of the support subassembly 6 has been removed for illustration. As can better be seen in FIG. 16, the axle 103 is actually formed by two separate pieces, in particular two partial, coaxial axles 103' and 103", which are independently attached to the longitudinal assembly 30, in particular to the web 35 of the H-beam 79.

Figure 4:
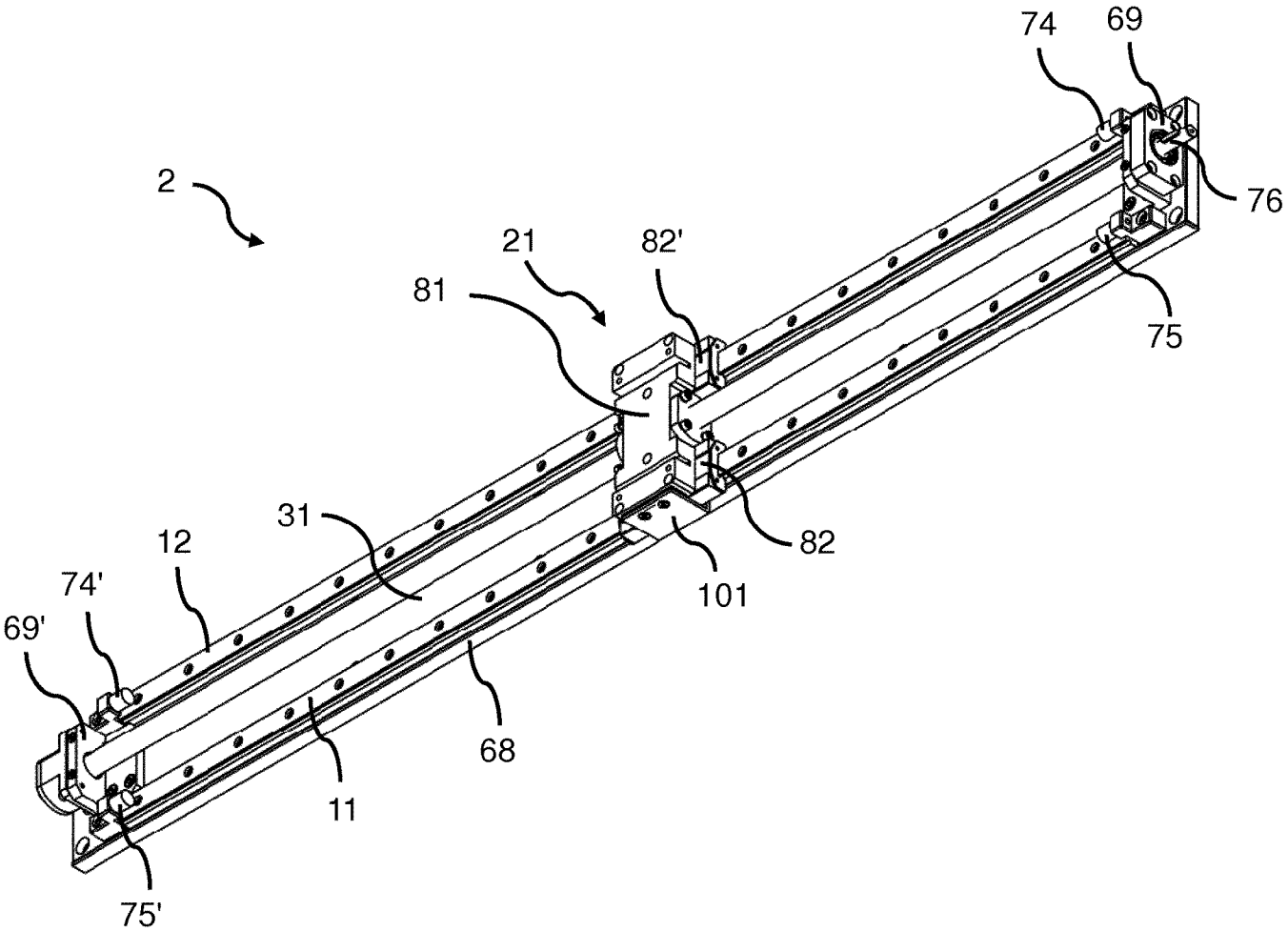
FIG. 4 is a perspective view showing in more detail the base including a pair of rails and a driving screw of the embodiment shown in FIGS. 1 to 3.
Figure 5:
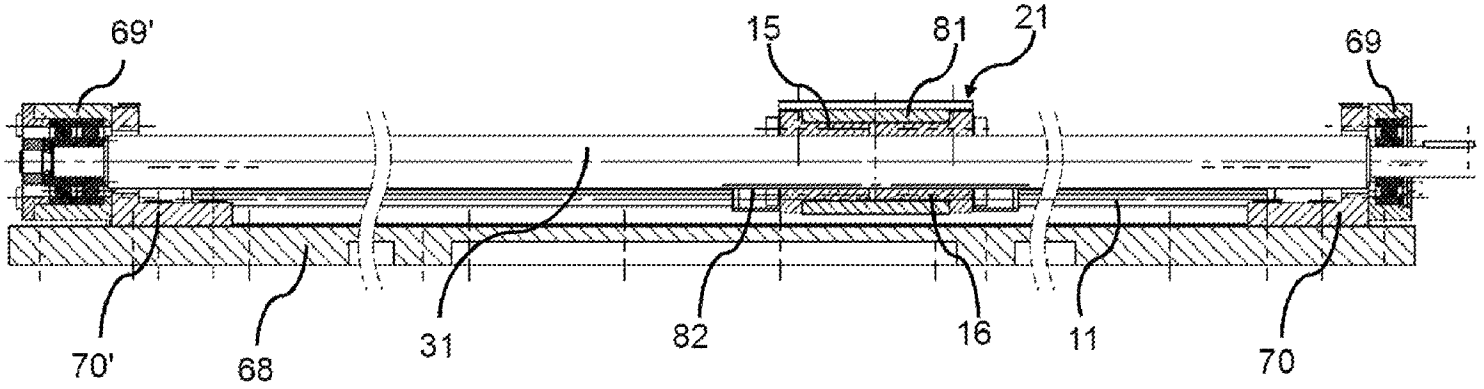
FIG. 5 is a longitudinal section along the plane A-A shown indicated in FIG. 6.
Figure 6:
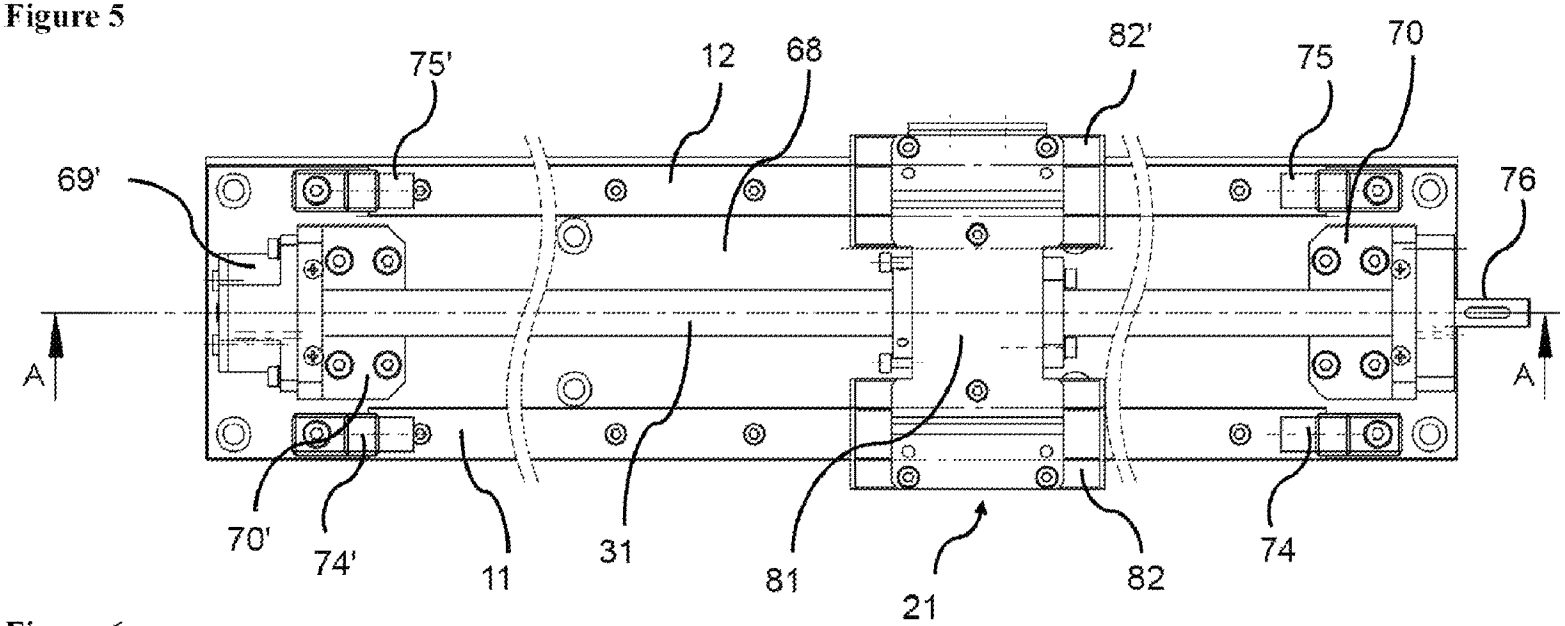
FIG. 6 is top-down view of the base shown in FIG. 4.

In FIGS. 4 to 6 below, some constituents and extracts of the base 2 of the device of the invention are shown in more detail. In FIG. 4, a pair of rails 11, 12, some parts of the first cart 21 and the first drive screw 31 and the fixation of these parts are shown. FIGS. 5 and 6 show the same extract as FIG. 4 in longitudinal section and top-down view, respectively. As can be seen, the rails 11, 12 are fixed on a separate support structure or base 68, which has the form of a plate or board. The support structure 68 comprises preferably an even overall surface, allowing even fixation of the rails thereon. The driving screw 31 (threads not shown) is carried in ball bearings of holding pieces 69, 69' provided at the extremities of the screw. At the extremities of each rail, mechanical stoppers 74, 74' and 75, 75' are provided, limiting the course of the first cart 21 mechanically. During regular operation the device of the invention, the cart 21 should not reach the mechanical stoppers at the end of the rails, as the course of the first cart is controlled electronically, by way of electrical stoppers (FIG. 19), which indicate when the carts are close to the mechanical stoppers.

At one extremity, a short shaft or pin 76 of the driving screw 31 extends axially beyond the ball bearing in the holder piece 69. On the pin 76, the pulley 77 of the first driving screw fixed in a rotationally fixed manner with respect to the driving screw 31, as can be seen in FIG. 3, as in FIG. 4 the pulley 77 and the motor 41 are not shown. Therefore, the rotation of a motor axis of the first motor 41 is transmitted to a pulley on the motor, and from the "motor-pulley" by a belt 78 to pulley 77, thereby propelling driving screw 31 (FIG. 3). There is also a gearshift provided between the motor axle (not shown) of the first motor 41 and the axle propelling the motor pulley. In the embodiment shown, the ball-bearing holder pieces 69, 69' are fixed to the base or support plate 68 by way of way of L-pieces 70 and 70'. Each L-piece 70 and 70' is a section of or cut-out taken from an L-profile, having an L-shape when seen in the view of FIG. 5. In FIG. 5, the ball bearings for rotatably carrying the drive screw 31 are shown in black and do not carry reference numerals. As one can see, two ball bearings are harbored by holding piece 69', at the extremity of screw 31 that is opposed to the pulley 77 and the first motor 41.

An identical and/or analogous construction (motor, gearshift, motor-pulley, belt, screw-pulley, etc.) is used to propel the second driving screw 32 (FIG. 3), not shown in FIGS. 4-6.

In FIGS. 4 to 6, the chassis 81 of the first cart 21 is shown, as well as two sliders 82, 82', which are arranged to slide on the rails 11 and 12, respectively, and which sliders are rigidly fixed to the chassis 81. Other structural parts of the first cart 21, which have been removed in FIG. 4 for clarity, are shown in greater detail in FIG. 7.

The second pair of rails 13, 14, the second cart 22 and the second driving screw 32 are constructed, arranged, and mounted independently as described for the first pair of rails shown in FIG. 4, with the specific orientation of the corresponding parts being derivable from FIG. 3, for example.

Figure 7:
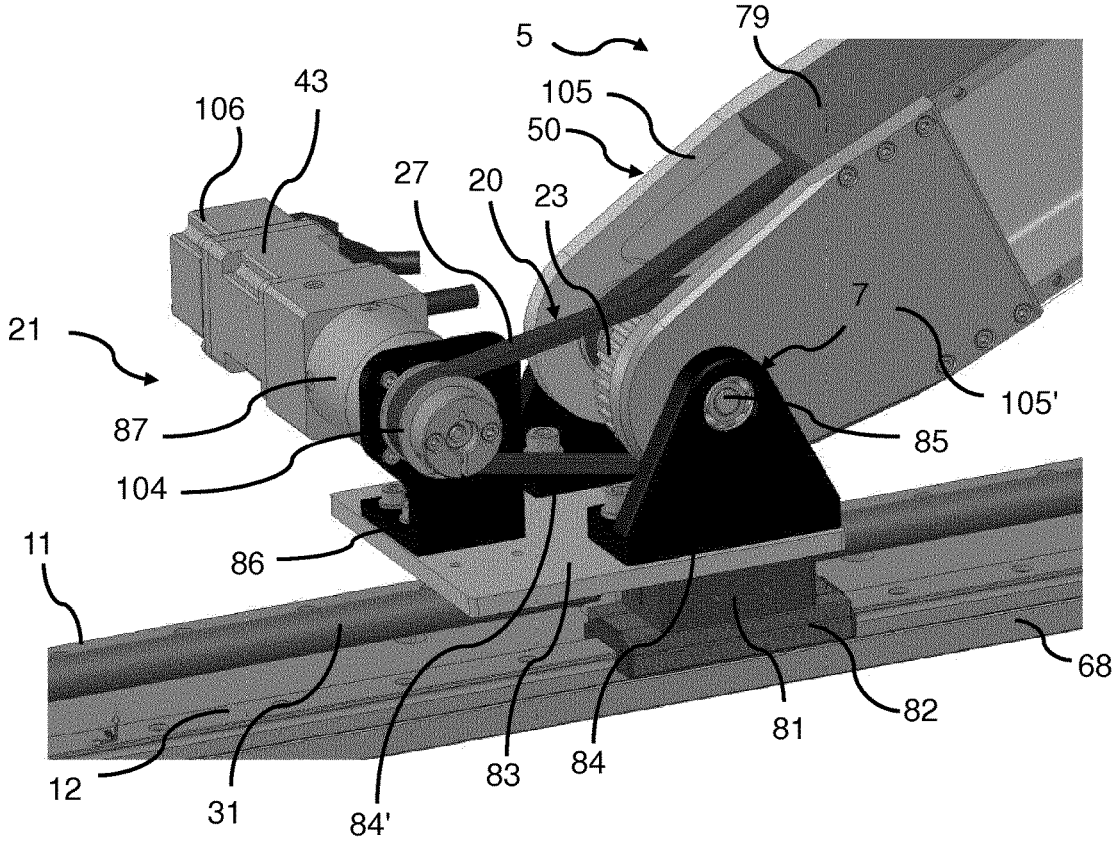
FIG. 7 is a perspective, enlarged view of the first driving cart of the device shown in FIGS. 1-3.
Figure 8:
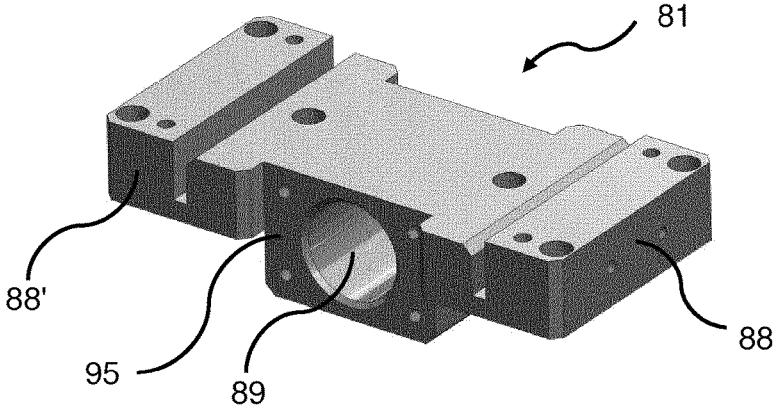
FIG. 8 is a perspective view of the chassis of the driving cart of the device shown in FIGS. 1-3.

FIGS. 7 to 12 show the constructions, the functioning and the driving of the sliding carts at the example of the first cart 21. As in the other figures, the external thread of the drive screw 31 is not shown. As can be seen in FIG. 7, the cart 21 comprises sliders 82, 82' (slider 82' can be seen in FIGS. 4 and 6), which slide on the pair of rails 11 and 12. The sliders are fixed on the chassis 81, preferably on the lower side or bottom side of the chassis 81 of the cart 21. The cart 21 is driven by the rotation of the driving screw 31, more particularly by way of engagement of a rotationally fixed inner threading on the cart 21 with the external threading of the driving screw, as will be detailed with respect to other figures. On FIG. 7, the platform or plate 83 can be seen. This platform is preferably fixed or otherwise connected on the upper side of the chassis 81. The platform 83 forms the support for the mount 84, 84' for the first cart articulation 7. On the first cart 21, the mount 86 for the third motor 43 is also fixed on the platform 83. As can be seen from FIG. 3, for example, a motor is absent on the second cart 22 and is not needed there. Turning back to FIG. 7, the main framework subassembly 5 is linked by way of articulation 7 to the first cart 21. In the embodiment shown, the first articulation 7 comprises two mount plates 84, 84' carrying each a ball bearing, the two ball-bearings rotatably carrying an axle 85 to which the main framework subassembly 5 is rigidly connected. Two pulleys 23, 23' are coaxially and rotatably arranged on axle 85. Of these two pulleys, only the larger pulley 23 can be clearly seen, the smaller pulley 23' being partially covered by structural elements in FIG. 7. These two co-axial and co-rotational pulleys 23, 23' and the belt 27 are part of the transmission assembly 20, which transmit the rotational movement from the third motor 43 to the foot contact assembly 44, as will be described in more detail elsewhere in this specification. In FIG. 7, the cables for powering the third motor 43 and for transmitting signals from the motor are not shown (are truncated). In the embodiment shown, a gearing mechanism 87 is provided, which reduces the rotations of the motor to the desired value. A decoder 106 is provided, for determining the power consumed by the third motor 43.

FIGS. 8 to 11 show in more detail the way the driving screw drives the carts and how undesired plays between the screw and the inner threading on the cart are adjusted in accordance with a preferred embodiment of invention. The chassis 81 can be seen in FIG. 8 as an isolated piece. One can see in particular a central bore or hole 89 crossing the body of the chassis 81 in the axial direction (along the moving axis of the cart). The driving screw 31 is guided in this hole. The chassis comprises two lateral wings 88, 88' on the left and right side. The sliders 82, 82' are fixed on the bottom the wings 88 and 88' (FIGS. 4 and 7), and the platform 83 is fixed on top of the chassis 81, as shown in FIG. 7.

In the embodiment shown, the hole 89 of the chassis does not contain an inner threading itself. However, inner threading holding pieces 15, 16, a first inner threading holding piece 15 and a second inner threading holding piece 16, are fixed in the cart 21, in particular on the chassis 81 (FIGS. 9-12). In the embodiment shown, the first and second inner threading holding pieces 15, 16 are nuts comprising an inner threading. The nuts 15, 16 have a hollow cylindrical section 93, 94, respectively, in which the inner wall comprises the inner threading (the inner threading is not shown in the figures). The hollow cylindrical sections can be seen in FIGS. 11 and 12. Furthermore, each nut 15 and 16 comprises a flange 91, 92, respectively, abutting against a respective abutment surface 95, 96, provided on the chassis 81, at the axial entries of the bore 89. Accordingly, the hollow cylindrical part 93 of the first nut 15 extends partially into bore 89 on one axial end of the cart 21/chassis 81, and the flange 91 of nut 15 abuts on the flat abutment surface 95 on this axial end of the chassis 81 (on the left side of FIGS. 9-11). At the other axial end of the chassis 81 (on the right side of FIGS. 9-11), the hollow cylindrical part 94 of the second nut 16 extends into the bore 89 of the cart 21/chassis 81, and the flange 92 of nut 16 abuts on the flat abutment surface 94 on this axial end of the chassis 81. The expression "axial end" refers to the ends or limits of the chassis/cart in the two directions on an axis extending coaxially or in parallel to the axis of the driving screw 31, as the cart moves on the driving screw. The two abutment surfaces 94, 95 are provided in parallel planes at the opposing axial ends of chassis 81.

Figure 13:
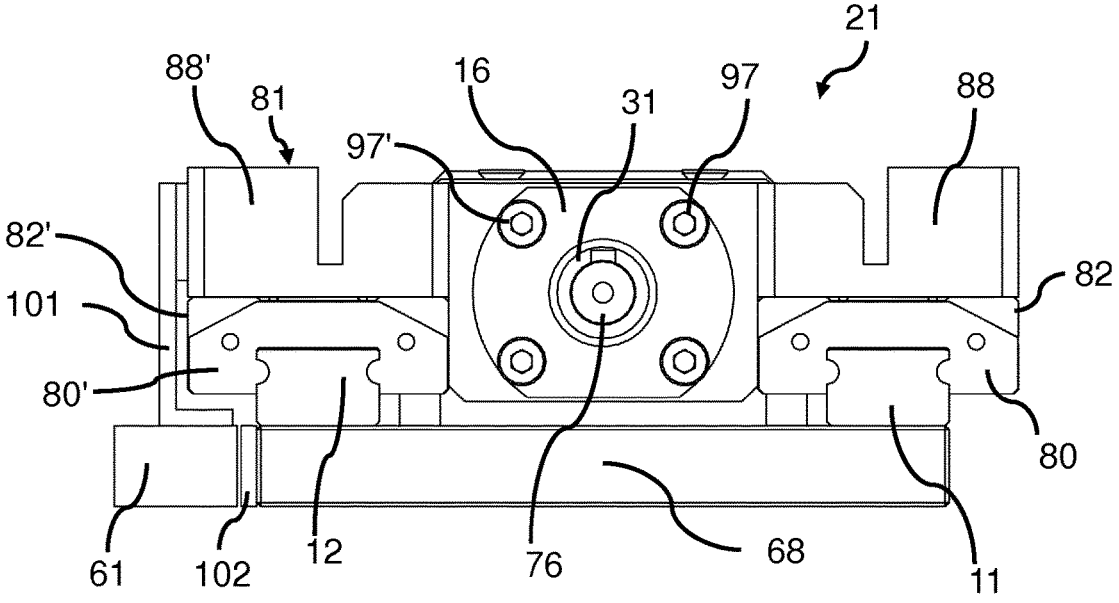
FIG. 13 is a side elevation view to the partially demounted driving cart, differing from that shown in FIGS. 9-12 in that a linear encoder is visible.

It is noted that the second nut 16 (or second inner threading holding piece) is rigidly fixed on the chassis 81, by way of screws 97, 97', 97" and 97'". These screws 97 extend through bores in the flange 92 of the second nut and are anchored in the body of the chassis 81. The flange 92 has a roughly rectangular contour, with straight top and bottom borders, as can be seen in FIG. 13. As one can understand, once the nut 16 is inserted in the bore 89, and fixed by screwing, it is fixed rotationally, as well as axially on the chassis 81/cart 21, and so is its inner threading (not shown) provided on the inner surface of the hollow cylindrical part 94. The second inner threading holding piece 16 is thus fixed in a non-adjustable, rigid manner to the chassis 81/cart 21.

The play between the outer threading of the driving screw 31 and the inner threadings of the nuts 15 and 16 can be adjusted as described herein below. It is noted that the first nut 15 (or first inner threading holding piece) is fixed in a different manner to the chassis 81/cart 21 than the second nut. First nut 15 is fixed once the driving screw 31 is already inserted through bore 89 and threadedly engaged with the second nut 16. In other words, when mounting the device of the invention, the first nut 15 is inserted and blocked only once the second nut is already rigidly fixed to the chassis 81. The first nut 15 is then rotated on the screw 31 until it abuts against abutment surface 95 of the chassis 81. Further rotation leads to a certain axial traction on the screw, as the axial movement of the first nut 15 is blocked in this direction by the abutment surface 95 of the chassis. This traction can be conducted by turning the first nut 15 until the play between the drive screw 31 on the one side and, on the other side, the inner threading of nuts 15 and 16 considered together (as a whole) is zero or close to zero. It is noted that by further turning nut 15 once it already abuts against abutment surface 95 cannot lead to further insertion of the nut into the bore, as the nut is blocked in this direction. Further turning leads, however, to a rotation of the inner threading of the nut 15, and this rotation will at some point be counteracted by the outer threading of the driving screw 31, resulting in the traction mentioned.

Figure 9:
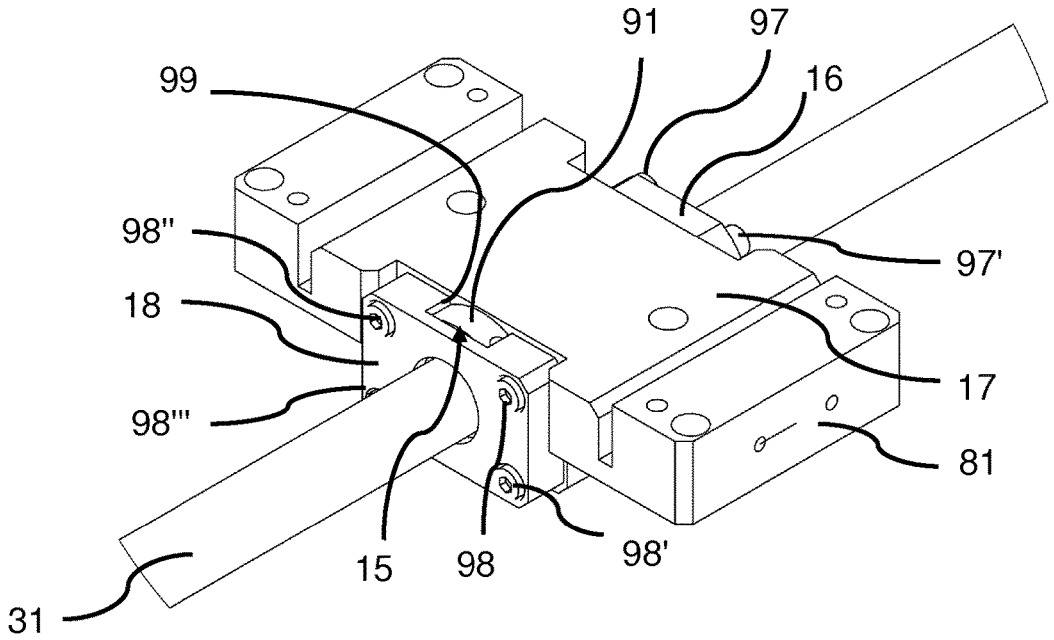
FIG. 9 is a perspective view to the first driving cart shown in FIG. 7, from which several pieces have been removed.

Once the play is adjusted as desired by rotation of the first nut 15, the latter is blocked rotationally by a blocking device 18. In the embodiment shown, the blocking device 18 is a flask or clamp 18, which is fixed on the chassis 81 so that it presses or clamps the flange 91 of the first nut 15 onto the chassis 81, and more particular onto the abutment surface 95 of the chassis 81. The clamp 18 comprises a central bore, through which the drive screw 31 extends (FIG. 9). The clamp 18 is fixed by screws, of which screws 98, 98', 98" and 98'" can be seen in FIG. 9. Once the clamp 18 is fixed, it blocks rotation of the first nut 15, and thus prevents a change of the play adjusted previously. It is noted that the flange 91 of the first nut 15 has a circular contour.

Figure 10:
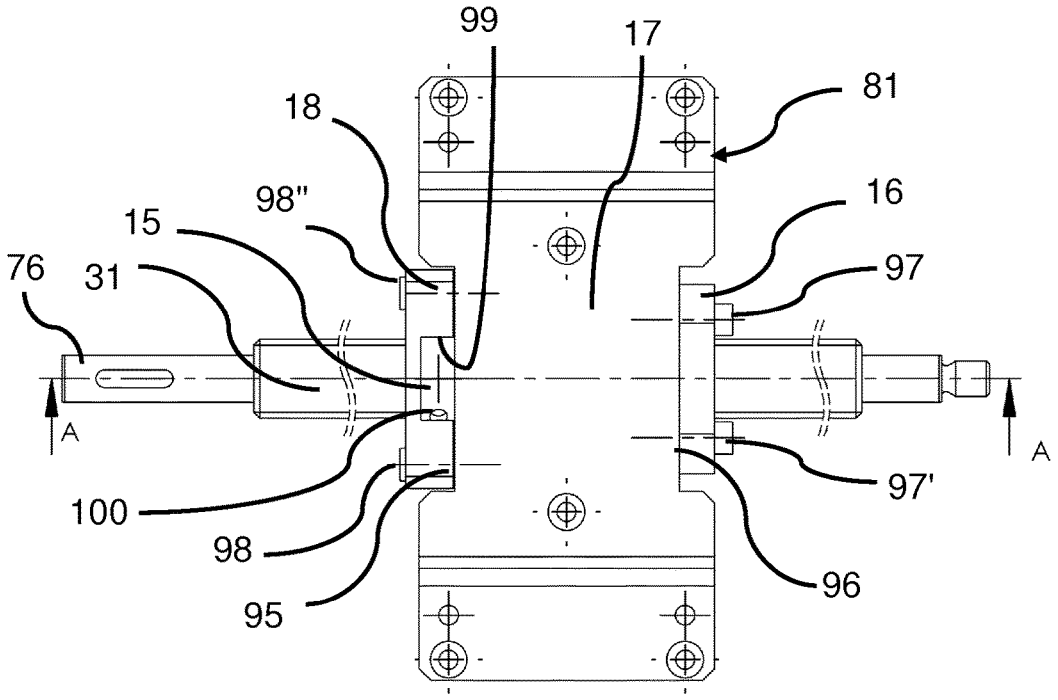
FIG. 10 is a top-down view to the driving cart as shown in FIG. 9.
Figure 11:
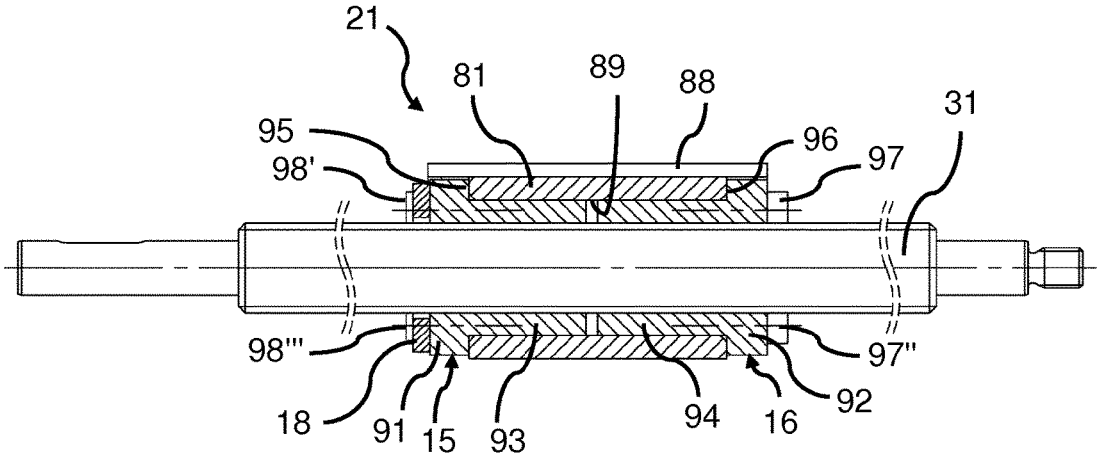
FIG. 11 is a longitudinal section of plane A-A as shown in FIG. 10.
Figure 12:
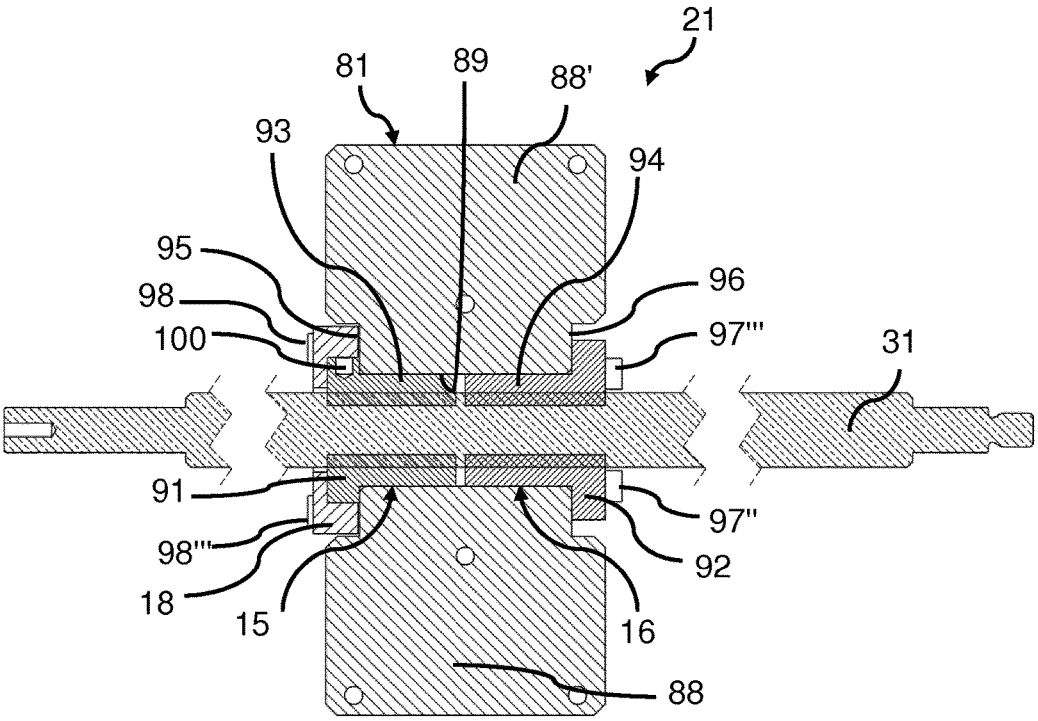
FIG. 12 is a cross-section of the partially demounted driving cart shown in FIGS. 9-11.

The clamp 18 comprises at least one cut-out or opening 99, giving access to the flange 91. In FIGS. 10 and 12, a bore 100 on flange 91 can be seen in the region of the cut-out 99. The bore 100 extends radially into the flange 91 (radially with respect to the axis of the driving screw). Actually, the flange 91 comprises a plurality of such radial bores 100, so that it is ascertained that at least one bore can be seen and accessed through the cut-out 99. the combination of clamp 18, cut out 99 and bore 100 allows to adjust the play between the outer threading of the screw and the inner threading of the inner threading holding pieces 15, 16, if necessary, for example during maintenance of the device of the invention. In order to do so, screws 98, 98', 98" and 98'" are loosed, so as to allow rotation of nut 15. An operator/technician uses a tool, for example a tool comprising a pin fitting in bore 100, and inserts it into bore 100 accessible through the cut-out 99. The technician can cause rotation of the first nut 15 by acting on the tool, in particular by pivoting the tool. This rotation is transmitted to the first nut 15 and thus its inner threading, which results in a modification of the play as described above.

Of course, the present invention encompasses further ways of blocking the inner threading holding piece 15 at a rotationally desired and/or adjusted position, in order to adjust play. In particular, the invention encompasses the adjustment of the rotational position of the inner threading holding piece 15 while being in an axially determined or fixed position, in order to adjust the play/tolerance/clearance. Furthermore, the invention encompasses in general a mechanism and/or adjustment device for adjusting the rotational position of the inner threading holding piece when fixed on the chassis 81 of the cart 21. The invention encompasses the use of a separate and/or specific tool for adjusting the inner threading holding piece during maintenance, for example.

FIG. 13 is a side elevation view on the base and a driving cart as shown in FIG. 4, with the stoppers 74 and 75 and further structural elements on the right extremity of the rails 11, 12 being removed. The view of FIG. 13 is taken from the right side of FIG. 4, which is the side where the first motor 41 is mounted to drive the driving screw 31. In FIG. 13, also the ball bearing, the ball bearing holding piece 69, and the L-piece 70 are removed compared to FIG. 4, so as to provide an elevation view on the cart 21. The particular view of FIG. 13 shows the presence of a linear encoder 61, fixed on the first cart 21. The linear encoder is connected by a holding piece 101 (also appearing as an L-form in FIG. 13), so as to be positioned close to a magnetic band or strip 102. The magnetic strip is attached on the support structure 68 and extends substantially in parallel to the rails 11, 12. The magnetic linear encoder 61 is thus arranged to produce a signal that communicates the actual position of the first cart 21 on the pair of rails 11 and 12. As will described elsewhere in this specification, linear encoder 61, together with further equipment, produces redundant information regarding the position of the cart 21, thereby contributing to the proper functioning and safety of the device. It is noted that on FIG. 3, the second linear encoder 62 can be seen on the second sliding cart 22. In FIG. 3, the first linear encoder 61, situated on the first driving cart 21 is hidden by the third motor 43.

The actual position of a sliding cart could also be determined, for example, using an optic linear encoder instead of the magnetic encoder 61 and an optic ruler instead of the magnetic strip 102. As a further alternative, the actual position of the cart could be determined using a draw wire sensor, for example, in which one part of the sensor is fixed at an extremity of the rails and the other part on the cart.

Therefore, there are several possibilities of sensors or encoders for determining the actual position of the cart on their respective rails, and the cited possibilities just represent exemplary embodiments.

FIGS. 14 to 17 show in more detail the main framework subassembly 5 of the right AS (FIG. 1) of the device of the invention. In these figures, the main subassembly 5 is detached from the device.

The main framework subassembly 5 comprises a connection subassembly 50, longitudinal subassembly 30 and a foot support carrying subassembly 44.

The transmission subassembly 20 can be considered as part of all subassemblies 50, 30, and 44 of the main framework subassembly 5, and even of the sliding cart 22. On the other hand, the transmission assembly 20 can also be considered as an own or separate subassembly 20 that is carried by or in contact with all these subassemblies 50, 30 and 44 and/or the cart 21. The transmission 20 assembly transmits the rotational movement of the third motor 43 to the foot contact assembly 4.

Figure 15:
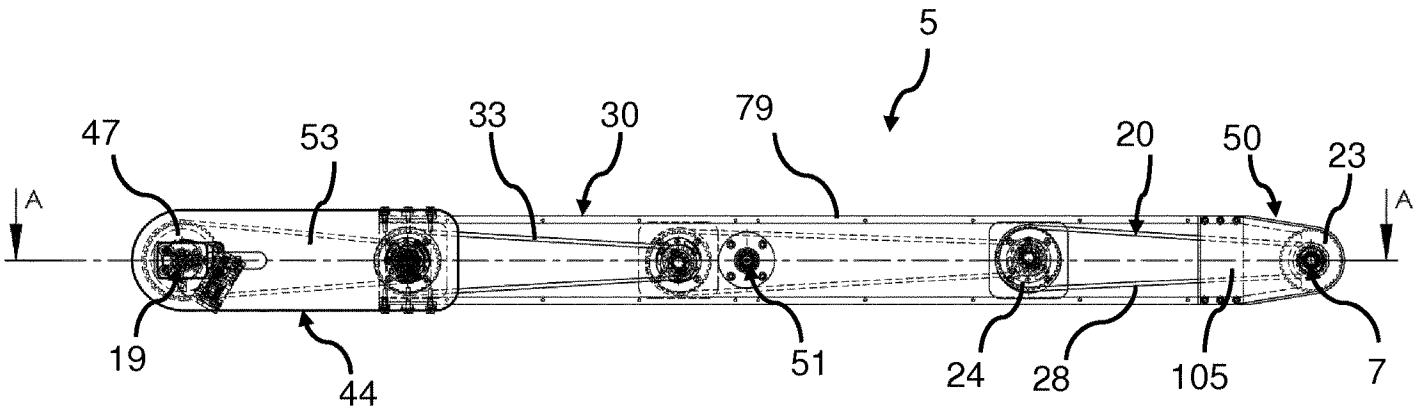
FIGS. 15 and 16 are side elevation and cross-sectional views, respectively, of the subassembly shown in FIG. 14.
Figure 16:
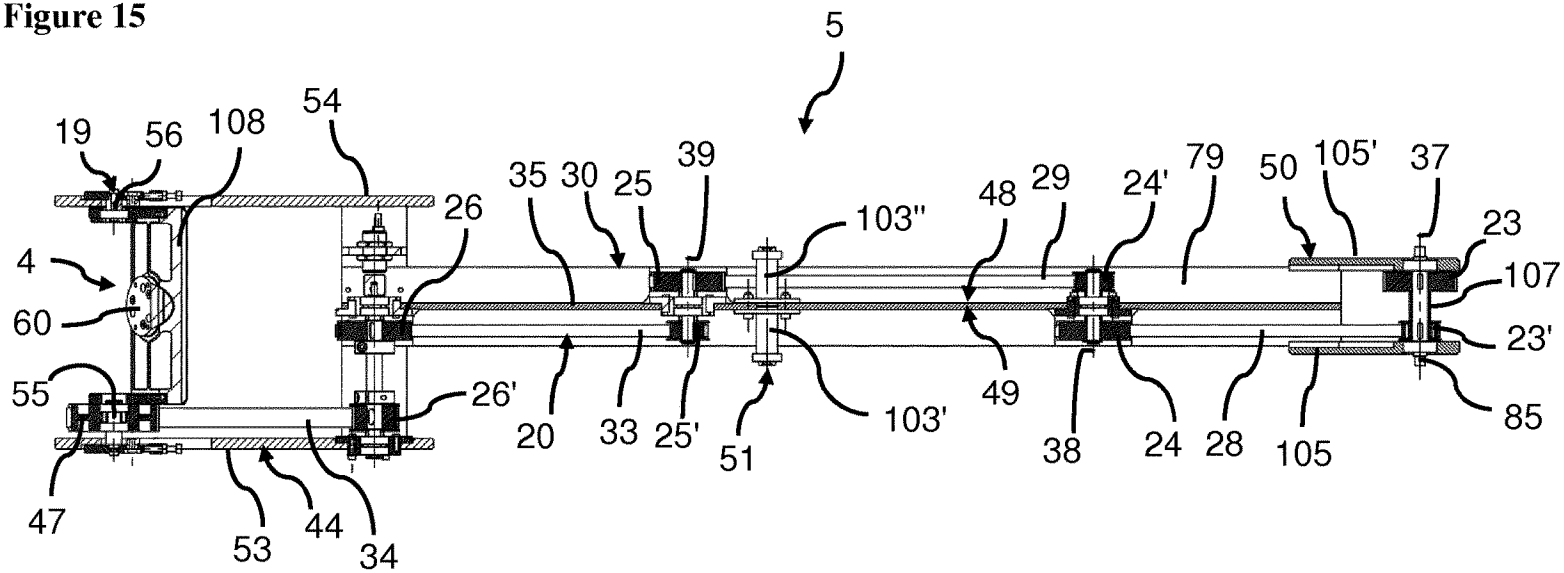

The connection subassembly 50 contains the axle 85, which is part of the first cart articulation 7 by which the main subassembly 5 is pivotally connected to the first cart 21. The axle 85 is rotationally harbored between two lateral plates 105, 105' of the connection subassembly 50. These plates are rigidly fixed to the one (proximal) extremity of the longitudinal subassembly 30, the latter providing the longitudinal support and carrier function for the foot support subassembly 4. At the other (distal) extremity, the longitudinal subassembly 30 is connected to the foot support subassembly 4, the latter comprising and carrying the foot contact plate 52. In FIGS. 14-16, the foot contact plate 52 has been removed for reasons of clarity.

In the embodiment shown in the figures, the carrying structure 79 of the longitudinal subassembly 30 is a H-beam. Of course, any longitudinal support or carrying structure 79 could be used in the alternative, such as profiles other than H profiles, such as I, L, U, T profiles, for example, or a combination comprising several longitudinal structures. The carrying structure of the longitudinal subassembly 30 can also be selected from flat bars, such as boards, or from hollow prisms, for example.

The longitudinal subassembly 30 comprises a bearing assembly 51, which, in the assembled device, holds the axle 103 by which the support subassembly 6 is pivotally connected to the main framework subassembly 6. The bearing assembly 51 preferably comprises at least two ball bearings, of which ball bearing 109 can be seen in FIG. 14, and axle 103 for holding the ball bearings and for connecting them to the longitudinal subassembly 30, in particular to the carrying structure 79.

In the embodiment shown, the transmission assembly 20 comprises a plurality of pairs of co-rotational belt pulleys 23, 23'; 24, 24'; 25, 25'; 26, 26' and pulley 47 and a plurality of driving belts 27, 28, 29, 33, 34 acting on and interlinked with said belt pulleys. The rotational movement from said third motor 43 is transmitted via and/or by aid of said transmission system to a rotation axis of said foot contact assembly 4. In particular, an axle propelled by the third motor propels a motor pulley 104 (FIG. 7). In the embodiment shown, the rotation axle of the motor pulley 104 is coaxial with the axle of the motor reducing gear 87. The motor reducing gear is coaxial with the axle of the motor.

Rotation of the motor pulley 104, propelled by the motor 43 via reducer 87 is transmitted via/by way of the motor belt or first belt 27 to the pulley 23, which is part of the first pair of pulleys 23, 23' of the transmission assembly 20. In the embodiment shown, the first pair of belt pulleys 23, 23' are coaxial with the axle 85 of the first cart articulation 7. In the embodiment shown, the first pair of belt pulleys 23, 23' are fixed on the axle 85 and rotationally blocked with axle 85. Axle 85 is guided in a pair of ball bearings, a ball bearing being fixed in each of the mount plates 84, 84', respectively, of the first sliding cart 21. One such ball bearing of axle 85 can be seen in FIG. 7. A second pair of ball bearings (not visible) is fixed in each of the lateral plates 105, 105' of the connection subassembly 50 (FIGS. 7 and 16). The ball bearings in plates 105, 105' allow the independent rotation of the main longitudinal subassembly 5 with respect to axle 85. In FIG. 16, a spacer tube 107 can be seen, which is provided on axle 85, and which has the purpose of keeping the pulleys 23, 23' at a determined or required distance, or simply assisting keeping them in place.

The two belt pulleys 23, 23' forming the first pair of belt pulleys are connected so as to be rotationally fixed with respect to each other (FIG. 16). The rotation of the pulley 23, propelled by the first belt 27 results in co-rotation of belt pulley 23'. A further belt (the "second" belt 28) lies on belt pulley 23' and also on pulley 24 and connects these two pulleys rotationally. By way of the second belt 28, the belt pulley 23' transmits the rotational movement to pulley 24, which belongs to a further or second pair of pulleys 24, 24', which is arranged further distal on the main framework subassembly 5. The other pulley 24' of said pair of pulleys 24, 24' is rotationally fixed to pulley 24. Furthermore, the pulleys of the second pair of pulleys are coaxial, besides being co-rotational. A third belt 29 lies on pulley 24' and on pulley 25, the latter belonging to a third pair of coaxial and co-rotational pulleys 25, 25', which are connected yet further distally (further away from the base 2 and/or from the first cart articulation 7) on the main framework subassembly 5, in particular on the longitudinal carrier structure 79. From the third pair of belt pulleys 25, 25', the rotational movement is transmitted by way of belt 33 to a fourth pair of rotationally fixed, coaxial belt pulleys 26, 26', and from pulley 26' to the last pulley 47, which is the belt pulley of foot support surface assembly 4. Pulleys 26' and 47 are rotationally connected by driving belt 34.

The transmission assembly 20 transmits the rotational movement of motor 43 to the foot contact assembly 4. The power efficiency $\eta$ of the transmission assembly is P2/P1, with P1 being the power produced by motor 43 and P2 the power yield at the end of the transmission assembly 20 and/or by foot contact assembly 4. The belt- and pulley based transmission system is advantageous as $\eta$ is close to 1 or only slightly smaller than 1. For example, $\eta$ is 0.6-0.99, preferably 0.8-0.99, most preferably 0.9-0.99.

A transmission unit of the transmission assembly 20 is formed by two pulleys connected by a belt. According to an embodiment, the transmission assembly 20 comprises two or more, preferably three or more, more preferably four or more transmission units. In the embodiment shown in the figures, the transmission assembly 20 comprises five (5) transmission units.

When considered in the direction from the motor 43 to the foot contact plate 4, the first transmission unit comprises motor pulley 104, pulley 23 and belt 27. A further transmission unit comprises or is formed by pulleys 23' and 24 and belt 28. The third transmission unit comprises or is formed by pulley 24' and 25 and belt 29. The fourth transmission unit comprises or is formed by pulleys 25' and 26 and belt 33. The fifth transmission unit comprises or is formed by pulleys 26' and 47 and belt 34.

A transmission unit may work as an amplifier and/or as a reducer of the moment (M), if the two pulleys in a transmission unit have different radii. The transmission assembly 20 of the device of the invention comprises one or more reducers or reducing units, which reduce the moment considered in the direction from the foot contact assembly 4 (see also TOC specified elsewhere) to the motor 43. In the direction motor 43→foot contact assembly/TOC 4, the moment is increased.

As the skilled person will understand, in a transmission unit comprising two pulleys (pulley 1: usually the smaller of a pair of pulley, which is fixed to the motor axle, and pulley 2: bigger than pulley 1) and a belt, the tangential speed vtg, which is the linear speed of the belt, the tangential force Ftg and the power P remain constant (yield close). On the other hand, the angular speed ω and the moment M are dependent on the radius r of the pulley in accordance with the equations vtg=ω*r and M=Ftg*r. r1 and r2 being the radii of the pulleys 1 and 2 respectively, with vtg=ω1*r1=ω2*r2, ω1 and ω2 are the two angular speeds of the pulleys and the moments are M1=Ftg*r1 and M2=Ftg*r2. The power of the unit is P=M1*ω1=M2*ω2 (yield close). Small i represents the ratio of r2/r1 (or ω1/ω2), so that ω1=i*ω2 and M1=M2/i.

If r1 is smaller than r2, i is >1 and the angular speed ω1 is higher than ω2 and M1 is smaller than M2. On the other hand, if r2 >r1, ω1 is smaller than ω2 and M1 is larger than M2. In summary, in the case of the transmission in the direction from a larger pulley to a smaller one via a transmission belt, angular speed amplifies but the moment is reduced. The expression "reducer" and "amplifier" refer to the changes of the moment. If i>1, the belt- and pulley system works as a reducer having regard to the motor. Moment is reduced in a pulley with small radius compared to the pulley with a comparatively larger radius, if the two pulleys are connected via a belt, because i>1.

In the transmission system 20 of the embodiment shown in the figures, the transmission units goes from large wheels to small wheels when seen in the direction from foot contact assembly 4 (or TOC) to the motor 43, as can be seen in FIGS. 15, 16 and schematically in FIG. 19. Therefore, the transmission units depicted elsewhere in this specification are preferably reducers. On the other hand, when considered in the direction from the motor 43 to the foot assembly, the transmission assembly 20 amplifies the moment and reduces angular speed.

The transmission assembly 20 of the device of preferably comprises a plurality of reducers and/or amplifiers connected in series. In particular, the transmission assembly 20 comprises a one or more reducers connected in series from the foot contact assembly 4 (and/or the TOC) to the motor 43. Each reducer/amplifier being characterized by its value i (i1, i2, i3, i4, in), the overall reduction and/or amplification of the moment is the product of all i. According to an embodiment, n (the number of reducers/amplifiers in series) is an integer of 1 to 20, preferably 2 to 10, more preferably 3 to 8 and most preferably 4-6.

According to an embodiment, said transmission assembly 20 comprises a plurality of pairs of co-rotational (and/or rotationally fixed) belt pulleys 23, 23'; 24, 24'; 25, 25'; 26, 26', each pair of belt pulleys being coaxial.

As one can see from FIGS. 14 to 16 the two pulleys of a pair of pulleys, such in the first pair 23, 23', the second pair 24, 24', the third pair 25, 25' or the fourth pair 26, 26', have different diameters/radii.

In the embodiment shown, and in the direction from the motor to the foot support assembly 4, rotation is transmitted, within a pair of pulleys from a larger to a small pulley (for example, from pulley 24 to pulley 24'). Within a pair of coaxial pulleys, such as 24 and 24', for example, the angular speed ω and the moment M remain constant, but tangential speed vtg and tangential force Ftg become dependent on the radius. By analogy to the formulae provided above, when passing from a smaller to a larger pulley (r1<r2) within a pair of coaxial and rotationally fixed pulleys, ω remains constant. Vtg2 is higher than vtg1 and Ftg2 is smaller than Ftg1. In this manner, each pair of pulleys 26', 26; 25', 25; 24, 24'; and 23', 23 result in an increase of tangential speed and a reduction of tangential force in the direction TOC 4 to motor 43.

The power P remains roughly constant, in accordance with high η, within a transmission unit e.g. 24, 28, 23', within a pair of coaxial and rotationally fixed pulleys, such as 24' and 24, and also within the entire transmission assembly 20.

In FIGS. 14 to 16, the foot positioning plate or foot contact plate 52 (FIGS. 1, 2) has been removed for showing the parts beneath the plate 52.

During operation of the device, the foot contact assembly 4 rotates only within a defined angular frame. For example, the foot contact assembly 4 does not conduct any complete rotation, but pivots generally within an angular span of 270° or less, preferably 180° or less, for example 150° or less. Preferably, the moment accompanying rotation of the foot contact assembly 4 is increased compared to the moment of the motor pulley 104.

According to an embodiment, the carrying structure 79 of the longitudinal subassembly 30 comprises a flat, longitudinal structural element, which is oriented so that the flat part is vertical. In the embodiment shown in the figures, the carrying structure 79 is a H-beam, and the vertically oriented, flat structural element is the web 35 of the H-beam. The belt pulleys of the transmission assembly 20 are preferably oriented so that their axis of rotation is perpendicular to the vertically oriented, flat, longitudinal structural element 35. Preferably, the axis of rotation of the belt pulleys are horizontal. As can be seen in FIG. 16, web 35 comprises openings, through which the axles of at least one pair of belt pulleys 24, 24' are guided and born by ball bearings fixed on the web 35. In the case of pairs 24, 24' and 25, 25', the two pulleys of a pair of pulleys are fixed on opposing sides 48, 49 of the flat, longitudinal element 35. In this way, the transmission assembly 20 can be stabilized and/or wearing and/or attrition can be reduced.

According to an embodiment of the invention, said main subassembly 5 comprises an H-beam 30, connected at one extremity in a rotational manner to said first cart 21 and at the other extremity in a rigid manner to said foot support carrying assembly 44, wherein said H-beam comprises a web 35 oriented in a vertical plane, wherein said web comprises a first side 48 and a second side 49, said first and second sides being opposing sides of said web, wherein an axis and/or axle 38, 39 of a pair of said co-rotational belt pulleys 24, 24'; 25, 25' is perpendicular to said vertical plane and extends across said web, wherein two belt pulleys of a pair of belt pulleys are arranged each on one of the two opposing sides of said web. Said vertical plane is in particular a plane in which pivoting of the main subassembly 5 is free to or capable of occurring.

In the case of the pair of belt pulleys 26, 26' that is most distal to the base 2, one belt pulley 26 is fixed close to the flat, longitudinal structural element 35, the other being fixed next to one of the two lateral plates 53, 54 of the food support carrying assembly 44. A last, fifth and/or most distal driving belt 34 transmits rotation of pulley 26' of the fourth pair of pulleys 26, 26' to the belt pulley of foot support assembly 4 (the foot support pulley) 47. The foot support pulley 47, which is part of the foot support assembly 4, is connected in a rotationally fixed manner to the foot contact carrying assembly 44. The latter pivotally harbors the foot support assembly 4. In particular, foot support pulley 47 is coaxial with the axis of rotation of the foot contact assembly 4.

In accordance with an embodiment, said food support assembly 4 comprises a foot pulley 47 propelled by a belt 34 of said transmission assembly 20, wherein an axis of said foot pulley is co-axial with a pivoting axis of said foot support assembly 4.

The foot contact (or foot support) assembly 4 comprises a substantially flat piece or plate 52 having some lateral border or rim 128 where the heel of the subject is to be placed or blocked (FIGS. 1, 2). The shape and size of plate 52 allows for conveniently accommodating the foot of a subject. Further means may be provided for releasably attaching the foot on the foot contact plate 52, such as fastening means. In FIGS. 3 and 14 to 16 the foot surface or contact plate 52 has been removed for showing components that would otherwise been hidden by plate 52. One can thus see in FIGS. 14-16 the support piece, bar or structure 108 on which a force and/or torque sensor 60 is fixed, for providing a signal related to the force and/or torque exerted by the foot of a subject on the contact area on piece 52. The foot contact plate 52 is fixed on the force/torque sensor 60. Preferably, the foot contact plate 52 is fixed by way of screws, as the sensor 60 comprises bores with inner threads for anchoring screws.

In accordance with an embodiment of the invention, the foot support assembly 4 comprises a force/torque sensor 60 arranged to measure the force and/or torque applied by a foot put on said foot support assembly 4 and/or on a foot contact plate 52.

The sensor 60 is placed centrally on the support bar 108. The support structure 108 is connected to a ball bearing on each of its two lateral sides. The two ball bearings harbor each an axle 55, 56 connected to the first and second lateral carrier plates 53, 54, respectively. In this way, the foot contact assembly 4, comprising the support bar 108 with the sensor force/torque sensor 60 and the foot contact plate 52 rigidly fixed on the sensor, is pivotally carried on the foot support carrying assembly 44. In summary, a pivoting movement of the foot contact assembly 4 within the angular span defined above is driven by the third motor 43 and transmitted by transmission assembly 20 to said foot contact assembly. The articulation allowing pivoting movement and/or rotation of the foot contact assembly 4 is also referred to herein as foot support articulation 19.

In accordance with an embodiment, said longitudinal framework subassembly 5 comprises, preferably at its distal end, a first lateral carrier plate 53 and a second lateral carrier plate 54, wherein a pivoting axle 55 is born in a first bearing of said foot contact assembly 4, and/or wherein said axle 55 connects a foot pulley 47 propelled by a belt 34 of said transmission assembly 20 to said foot contact assembly 4 in a co-rotationally fixed manner. Preferably, a second pivoting axle 56 is born in a second bearing of said longitudinal framework subassembly and/or in said second lateral plate 54. Preferably, said first and second pivoting axles 55, 56 are co-axial.

In the embodiment shown, the transmission assembly 20 is based on a system comprising several belt pulleys and belts, in particular transmission units as described above, for transmitting the rotation from the third motor to the foot contact assembly 4. Of course, the rotational movement can be transmitted in other ways, for example by cables, gears, clutches or chains acting on the foot contact assembly 4. It is also possible to use a linear actuator and crankshaft unit for rotating the foot contact assembly, for example. An advantage of using a transmission based on belt pulleys and belts is the good yield and low loss.

It is also noted that the pulleys used in the transmission assembly 20 preferably comprises or consists of one or more cogwheels, as can be seen in FIG. 14, and/or preferably one or more cogged belts fitting on the cogwheels.

FIGS. 17 and 18 show a support or carrying system 110 in accordance with an embodiment of the device of the invention. The carrying system 110 is a mechanical construction for positioning the ASs 9, 900 vertically. System 110 can also be referred to as a verticalizer. The terms vertical" and "verticalizer" generally refer to the orientation of the base 2 and/or the rail tracks, which are oriented vertically in FIGS. 17 and 18. In particular, the AS s are kept in a vertical position in which the device of the invention can operate and be used by a user or subject. In this case the subject will generally be seated in a seat positioned in front of the device, wherein the seat can preferably be fixed at an adjustable distance and height in front of the device, in accordance with the size and further biometric features of the subject (not shown). The carrying system 110 has to be sufficiently stable, but is preferably movable when not used. This is possible with a system shown, based on a stable steel frame 111. The carrying system comprises a front side 112, left and right lateral sides 114, and a back-side 115. The left lateral side is not seen in the figures but its position can be derived from the perspective view of FIG. 17. The sides form a casing or cabinet 120. At the backside 115 of the cabinet there is at least one door 116, 116', which gives access to the interior of the cabinet from the backside. In the cabinet, one can find electronic equipment necessary for running the device, such as one or more transformer, motor control board and motor driver, input/output device, slave device, EtherCAT box, I/O EtherCAT terminal, DC voltage supply, fuse/, electrical circuit breaker, electrical filter, switch, Ethernet Boxes, fan, EtherCAT transmitter, EtherCAT switch, and a computer for controlling and running the device of the invention, for example.

The steel-frame 111 comprises a plurality of steel profiles 122, 122', 123, 123' extending at and forming the edges of the cabinet 120. In the embodiment shown, there are four vertical steel profiles 122, 122', 123, 123', forming the four vertical edges of the cabinet 120. There are also horizontal steel profiles 124, 124', 125 for connecting the vertical steel profiles. In the figures, not all the profiles and/or support bars of the steel frame 111 are visible, but can be deducted from the sides of the figures that are shown and from the apparent symmetric construction.

The carrying system 110 comprises a plurality of lateral supports or legs 117, 118, 119, 121, for further stabilizing the device, in particular the cabinet 120 of the invention and/or for preventing the device from falling down and/or tilting. The lateral supports are described at the example of the lateral support or support assembly 117, which is shown on the right in FIG. 17. Each lateral support comprises a raker and/or angular profile or bar 117', and a horizontal profile and/or bar 117". The horizontal bar 117" extends close to, in parallel and/or on the floor, and the raker 117' extends from a position close to or in vicinity of the distal end of the horizontal bar 117" at an inclined angle to the vertical steel profile or bar 122. A further steel profile 117'", for example extending vertically, may be provided to further stabilize a lateral support 117. At the distal end of each lateral support 117, for example at the distal end of each horizontal profile 117", there is an adjustment assembly 126 for adjusting the height of the piece 127 of the leg that is in contact with the floor.

The carrier system or verticalizer 110 allows the positioning of the device of the invention at any position in a locality, for example in a room, such as rehabilitation or exercising hall or center. The device can also be conveniently displaced by aid of the verticalizer, which would not be the case if one just fixes the ASs 9, 900 or the supports 10, 910 comprising the ASs to a wall, for example.

FIG. 18 shows the support and carrying system 110 from the backside. The cabinet 120 preferably comprises one or more doors 116, 116', which may be accessible from the backside, for example, as shown. These doors are shown in an open position, or half open in case of door 116', so that electric components present in the cabinet 120 can be seen.

For example, the drivers 211-213 for driving the motors 41-43 of the right AS 9 can be seen. The three drivers for the motors of the left AS 900 are next to drivers 211-213 (not referenced). Below the drivers, one can see the intermediate I/O unit (e.g. EtherCAT) 207, 1107, described elsewhere in more detail. The cabinet 120 further comprises the power supply units, such as 24V power supplier 214, and an electrical breaker or circuit breaker 214'. In the embodiment shown, the cabinet 120 comprises the voltage transformer 216, which transforms power received from an external power supply to the voltage required by the drives 211 to 213 of the device of the invention. The computer and/or data processing unit 200 can also be seen inside the cabinet 120.

In FIGS. 17 and 18, the cabinet 120 is free-standing and/or movable. The cabinet 120 may thus be displaced for putting it away when not used, for example. In FIGS. 17-18, the cabinet is stabilized by a plurality of lateral supports or feet 117, 118, 119, 121. The invention also encompasses that a cabinet, to which the device of the invention is fixed, is not or not only stabilized by feet. The cabinet may be stabilized in addition or alternatively, in another manner.

For example, the cabinet containing the electronic components may be fixed on a rigid, permanent support, such as a wall, pillar, floor or ceiling, for example. If the cabinet is fixed on its backside to a wall, for example, the device access to the components inside the cabinet is preferably allowed and/or enabled. Instead of a back-door 116, 116', one or more lateral and/or front doors may be provided for accessing the electronic components in the cabinet. It is noted that the front side is the side on which the device of the invention is fixed, in particular where the ASs are fixed. The ASs may thus be fixed on a front door of the cabinet, for example.

The invention thus encompasses that the cabinet is not free-standing and/or not movable or only movable after unfixing from the permanent support.

In another embodiment, the cabinet 120 may be placed next to the ASs, for example as a separate assembly and/or unit. In this manner, the depth of the entire system is reduced and access of the cabinet is kept free when the ASs are fixed on a wall, for example.

FIG. 19 shows the electronic components of an embodiment of the device of the invention. These electronic components are shown schematically with respect to the mechanical components, the latter also being shown schematically. In FIG. 19, mechanical pieces are shown with light green shaded background, rotation reducing units (gear boxes) and belt pulley assemblies with blue shaded background, sensors and decoders with purple background and command units such as motors, drivers, RT command, HMI and power sources with salmon pink background.

The device of the invention is controlled by a data processing assembly. The data processing assembly comprises a central data processing unit 200, in particular a computer 200 shown on the left side of FIG. 19. The computer 200 preferably comprises a Human Machine Interface (HMI) 205 and a Real Time (RT) computing unit 206.

Reference numerals 214 and 215 in FIG. 19 indicate sources of electrical power, which are used to provide electricity to the device of the invention. There are two reference numerals, as sources with different voltage (V) are used, as the different electronic devices have different requirements with respect to voltage. The main voltage source may be the 3-phase electricity network (3×230V) as existing in some countries. From this voltage, all other sources may be created. For example, a 24V voltage source 214 may be used for powering some sensors, encoders and the intermediate I/O device, a 3-phase 220V voltage source 215 may be used for powering the drivers 211, 212, 213 and a 5V supply may be used for powering some other sensors.

In FIG. 19, the belt-pulley assemblies reducing (from TOC to motors) the moment are indicated with characteristic graphic symbols. The moments of the first and second motors 41 and 42, are reduced by belt-pulley system 77/78 and 77'/78', respectively, in the direction indicated in FIG. 19 (smaller pulley is where the moment is reduced). The moment of the third motor 43 is reduced by belt- and pulley assembly 27/104 in direction from foot assembly 4 to motor 43 (TOC 4 to motor 43), which has been described in more detail elsewhere in this specification. Of course, the invention encompasses different possibilities for transmitting and/or reducing the moment in the direction from the foot contact assembly 4 to the third motor 43.

On the main λ-framework subassembly 5, one can see the sequence of belt/pulley-based reducers, which have been described in more detail with respect to transmission assembly 20 (FIGS. 14 to 16). A belt and the two pulleys connected by the belt form a reducer. In FIG. 19, the reference numbers of successive pulleys forming a reduction of the moment are indicated.

The device of the invention comprises motors 41, 42, and 43 for propelling the driving carts 21, 22 and for propelling the rotational movement of the foot support assembly and/or TOC 4. The three motors provide the three degrees of freedom covered by the AS of the invention. The device has preferably at least three degrees of freedom, which encompass a first and second degree of freedom provided by the first and second driving carts 21, 22, which allow the positioning and/or movement of the foot contact assembly and/or TOC 4 within a vertical plane (two axis of space) by using the λ-framework. The third degree of freedom is the ability of rotation of the foot contact assembly and/or TOC 4 on an (horizontal) axis that is perpendicular to said vertical plane of said first and second degree of freedom. As the skilled person will understand, the position of said first and second driving carts directly determines the position of the foot contact assembly and/or TOC 4 in said vertical plane of the first and second degree of freedom. Therefore, for the purpose of the discussion of redundancy features, data concerning the position of the first and second driving carts is equivalent to and/or can be mathematically converted into data concerning the position of the foot contact assembly and/or TOC 4 in said vertical plane.

In general terms, each motor is driven and/or controlled by the data processing assembly. More specifically, each motor 41, 42, and 43 is preferably driven by its own motor driver 211, 212 and 213. The motor drivers may be considered as being part of the data processing assembly. The motor drivers are preferably connected with the computer 200, for example. In particular, the first motor 41 is driven by the first motor driver 211, the second motor 42 is driven by the second motor driver 212 and the third motor is driven by the third motor driver 213. The drivers provide their respective motor with current and voltage required to achieve a required motor action so as to produce a movement of the TOC as desired or targeted.

Furthermore, each motor is connected to a shaft encoder and/or decoder. The first motor 41 is connected to the first shaft encoder and/or decoder 71, the second motor 42 is connected to the second shaft encoder and/or decoder 72 and the third motor 43 to the third shaft encoder and/or decoder 106.

In accordance with an embodiment, the device of the invention comprises motor shaft encoders 71, 72, 106 for determining the rotations and/or, more specifically, the angle covered by the rotation of the respective motor axle, for example. The signals of encoders 71, 72, 106 can be translated to a position of the respective cart 21, 22 driven by the motor 41, 42 on the rails, and/or to an angular position of the foot support assembly 4, driven by the third motor 43. For example, the start or original position of the motor may be related to a start position or a zero position, and, when operating, the position of the motor can be determined as the sum of rotations with respect to the start position. From this information, the position of the cart propelled by the respective motor can be determined. Rotation in the two (opposing) senses may then be treated with different algebraic signs (+/−), so that the position 0 always corresponds to the start position. The start or original position corresponds to a determined position of the cart driven by the motor on the respective rail track. Motor speed may be expressed in terms of number of rotations per time unit.

Preferably, the communication between the computer 200 and each motor 41, 42, 43 and shaft encoder 71, 72, 106 is managed by the respective motor driver 211, 212 and 213. The motor drivers receive information from the respective shaft encoder 71, 72, 106. The information may be selected from information related to the position of the motor (and thus of the driving cart), the speed of the motor, the acceleration, and the couples/moments.

In an embodiment, the motor drivers 211, 212 and 213 manage electrical characteristics to drive the motors. In particular each driver manages motor current intensity of the respective motor. The motor current is in direct relationship with the moment (and/or torque) that should apply. The motor current intensity is related to the force or strength applied by the subject to the foot contact assembly 4 (TOC). Regarding the rotational movement of the foot contact plate 52 and/or the foot contact assembly 4, the current intensity is related to the moment caused by the subject's action on said foot contact plate 52 and/or the foot contact assembly 4 through the transmission chain 20 discussed elsewhere in this specification.

The motor drivers 211, 212 and 213 are preferably arranged to send data and/or information from the respective shaft encoder 71, 72, 106 and/or from the respective motors 41, 42, 43 to the computer 200.

For moving the TOC in accordance with a particular exercise, the computer 200, the motor drivers 211, 212 and 213, the motors 41, 42, and 43 and their respective decoders 71, 72, 106 work together in a synchronized manner, preferably in real time. The driving of the movement of the TOC may also be referred to as movement control or exercise control of the device of the invention. In particular, the computer is programmed to have information regarding a specific trajectory to be executed by the TOC. A given trajectory is part of an exercise, such as the exemplary exercises specified elsewhere in this specification. The computer 200 mathematically transforms the trajectory to data concerning the angular position, speed and/or acceleration of each of the motors and sends this data to the drivers 211, 212 and 213, which transform the instructions to power to be provided to the motors. In turn, the drivers 211, 212 and 213 receive information from the motors and/or in particular from the shaft encoder 71, 72, 106 and send this information to the computer 200, which can thus monitor the trajectories actually performed. The computer 200 assesses if a position of a motor 41, 42, 43 as determined by the respective shaft encoder 71, 72, 106 corresponds to a "target position" of the TOC, for example a target position within the trajectory of the TOC. The computer 200 may adapt information sent to the driver in order to achieve the target position, for example to correct the position of the TOC if its position as measured by the encoders 71, 72, 106 is different from the target position. Also termination program can be triggered if the difference between the target position and the measured position exceeds a threshold value.

Of course, the control of the movement of the TOC involves real time and closed loop procedures and/or programs running on the computer 200 as well as in the motor drivers 211, 212 and 213.

In an embodiment of the invention, information of the motor drivers, in particular information about the current consumed by the motors is used to determine the force applied by the subject to the TOC 4. The current consumed by any motor can be retrieved from the respective motor driver 211, 212 and 213, and this information can be used to determine the force applied on TOC, optionally taking further available information into account. Further information and/or parameters concern the device (e.g. current consumption flow in absence of a subject) and/or the subject doing the exercise. The data processing unit preferably compares the data about current obtained from motor drivers and force/torque sensor to data concerning force on the TOC obtained in another way, as disclosed elsewhere in this specification, for example from the force sensor 60.

The force and/or torque sensor 60 is preferably provided at the TOC, in particular below the foot contact plate 52. The sensor 60 is present in a preferred embodiment of this invention, preferably it is an important element of the device of the invention, because it is the sensor that is closest to the interface with the subject (closest to the TOC). The sensor 60 preferably produces signals concerning the force and torque exerted by the foot of the subject placed on the foot contact plate 52 (FIGS. 1, 2). While only one force and/or torque sensor 60 is shown for the purpose of illustration, the functions of the sensor 60 may be accomplished by one or a plurality of different sensors. According to an embodiment, the device of the invention comprises one or a plurality of sensors for measuring the force and/or torque exerted on the foot contact plate 52 by a subject and/or user of the device of the invention.

According to a preferred embodiment, the device of the invention comprises one or a plurality of sensors for measuring the force and torque exerted on the foot contact plate 52 by a subject and/or user of the device of the invention.

According to an embodiment, the device of the invention comprises one or a plurality of sensors for measuring the force on the three axes (Fx, Fy, Fz) of space.

According to an embodiment, the device of the invention comprises one or a plurality of sensors for measuring the torque on the three axes (Mx, My, Mz) of space.

Most preferably, the device of the invention comprises one or a plurality of sensors for measuring each force and torque on three axes of space. Preferably, a single six-axis force and torque sensor is used. However, the invention encompasses the use of several sensors for measuring force and torque with respect to all directions. For example, the invention may comprise two sensors 60, one being capable of measuring force on three axes (Fx, Fy, Fz) and the other being capable of measuring torque on three axes (Mx, My, Mz). Alternatively, reference numeral 60 may refer to a plurality of sensors, each sensor measuring force and torque on one axis only (Fx, Mx; Fy, My, and/or Fz, Mz). By combining three such sensors, each sensor measuring force and torque on one of the three special axes, signals with respect to all six axes (three force axes and three torque axes) are produced.

Although measurement of force and torque in all directions (six-axes) is preferred, the invention also encompasses a sensor 60 that measures only force or only torque. Furthermore, the invention encompasses one or more sensors 60 measuring force and torque on only one or only two axes of space (e.g. Fx, Mx and Fy and My), for example.

In accordance with the above said, for the purpose of this specification reference to "the sensor 60" includes specifically also the plural form ("the sensors") in case there are several sensors as specified above, for example.

In accordance with an embodiment, the sensor 60 is suitable to produce a signal that allows the computer 200 to assess if the foot of a subject is placed on the foot contact plate 52. If no force and/or torque whatsoever is measured by the sensor 60, this means that no subject is positioned on the device and the TOC will not execute an exercise and/or will not produce any TOC movement. On the other hand, if the force and/or torque measured by the sensor 60 exceed a determined threshold value, this can be interpreted by the computer 200 as information that a subject is in contact with the TOC and that an exercise program can be run. The data produced by sensor 60 may thus function as a switch required for running an exercise on the device of the invention.

In accordance with an embodiment, the information produced by the force and/or torque sensor 60 is used together with information concerning the current produced by the motors in order to determine the force or moment on the foot contact assembly. In an embodiment, the information concerning the force and/or torque as determined by sensor 60 is suitable to be used by the computer 200 for determining the power required to achieve a given trajectory. In accordance with this embodiment, the information of the force and/or torque exerted by the subject on the sensor 60 may be transformed to instructions with respect to motor power that is sent to the motors 41, 42, and 43 via drivers 211, 212 and 213, respectively. It is noted, that the data from the force sensor 60 can in particular be used to determine the extent by which the action of the motors are assisted or counteracted by the subject. A given movement is associated with much more power if counteracted actively by the subject. In some exercises, the subject may accompany and/or support the movement driven by the motors, so that the power used by the motors is reduced for a given movement or distance.

In accordance with an embodiment, the information concerning the force and/or torque as determined by sensor 60 is used in safety monitoring procedures, which are more generally discussed elsewhere in this specification. In particular, if a force and/or torque as determined by sensor 60 exceeds a specific (second) threshold value, a safety termination or stopping procedure is rapidly started, for warranting the safety of the subject. The computer 200 can assess whether the data produced by sensor 60 indicates potential damage to the motors, due to overheating, for example. Motor damage or failure could in particular result in a risk for the subject using the device of the invention. The purpose of the force sensor 60, preferably associated with parameters related to the TOC strength on a specific trajectory given by motor speed and position, is mainly to ensure subject security, by braking the AS in case of accident or human failure.

As can be seen in FIG. 19, the device comprises a plurality of measuring devices, such as sensors and captors for assuring the safe operation of the device of the invention. In particular, the device of the invention comprises a monitoring system including the electronic components discussed above as well as further components discussed below so as to assure the safety of the subject using the device of the invention. In particular, the device of the present invention comprises a plurality of safety, security and/or redundancy features, for warranting proper functioning in all circumstances.

In particular, the computer 200 runs one or a plurality of monitoring programs adapted to check one or more redundancy features or signals in real time and in a closed loop procedure. The safety system and/or the monitoring programs ensure that the ASs is/are correctly positioned during operation.

According to an embodiment, the device of the invention comprises one or more linear encoders which produce a signal corresponding to the actual position of the driving carts on the longitudinal axis along the rails. In FIG. 19, the first and second linear encoders 61, 62 can be seen. Alternative sensors for determining the position of the first and second carts 21, 22 are described elsewhere in this specification. The first magnetic strip 102 contains information that can be read by sensor 61 for determining the position of the first driving cart 21, as has been described with respect to FIG. 13. On the second pair of rails 13/14, the corresponding magnetic strip is indicated with reference numeral 102', and the position of the second cart 22 is measured by linear encoder 62.

According to an embodiment, the device of the invention comprises an angle sensor 59, which produces a signal that indicates the angle of the foot contact assembly 4, for example with respect to a reference of the longitudinal main subassembly 5.

According to an embodiment, the device of the invention comprises an angle sensor 63 is situated close to the pivotal connection 51 of the main subassembly 6 with the support subassembly 5. The angle sensor 63 measures the angle between those two subassemblies.

The signal produced by any one or both of the angle sensor 59 and/or angle sensor 63 may be sent, independently to the intermediate device 207 and/or directly to the data processing unit 200, for example.

In accordance with the safety and/or monitoring system of the device of the invention, the data processing unit 200 of the invention is programmed to compare redundant data related to a position of said first and/or second carts and/or to a position of the Tool Operating Center (TOC) of the device, and to start one or more selected from a correction or termination program in case the data processing unit detects a determined inconsistency between the redundant data.

For the purpose of the present invention, the expressions "redundant data" and/or "redundant information" refer to data and/or information concerning a parameter of the device that is determined at least two times independently. Data may be determined more than two times, in particular n-times, with n being 1, 2, 3 or 4, or more, resulting in n-times redundant data. 1-time redundant data means that information concerning a parameter is obtained independently at least two times. The parameter may be any parameter that may be considered to be relevant for the controlled and safe operation of the device. Typically, the parameter is related or corresponds to the position of one or both driving carts, 21, 22, the angular position, the force and/or torque of the foot contact assembly 4, the angle between the main and support beams 5 and 6, just to mention a few examples. The fact of obtaining and using redundant data provides the "redundancy features" of the device of invention.

A "termination program", "exit program" or "emergency program" is a stop, braking and/or any type of program which results in the immediate abort of an exercise and brakes the motors of the devices of the invention. The purpose of braking the device is to prevent damage to the subject using the device of the invention. It is noted, in this regard, that the motors 41, 42, 43 are all independently equipped with brakes. The brakes are activated in accordance with the emergency and/or termination program. The brakes are preferably automatically activated in case of any type of anomaly, including a power cut, for example. In this way, the ASs is blocked at a specific position by the brakes and is prevented from falling down under the effect of gravity or from conducting any uncontrolled movement in general.

The expression "determined inconsistency" refers to the fact that the data processing unit assesses or is programmed to assess whether any inconsistency between redundant data is sufficiently relevant for requiring the start of a specific program. The relevance of an inconsistency may be assessed by comparison with a predetermined threshold value. In general, a specific program for correcting the position or for terminating the operation of the device is started only if the threshold value is reached or exceeded.

A "correction program" is a program that aims at obtaining and/or restoring consistency between the redundant data. Accordingly, a correction program generally sends instructions to any one or more motors of the device to speed up or slow down, as applicable.

Preferably, in the real time system and/or program, there is a "monitoring block" that checks every time unit at the millisecond range that the principal sensor values are matching with the values of the redundant sensors. If the difference of these values exceeded the maximum of the tolerance and/or threshold value, the system stops and insures the security of the subject. In normal operation, this should not happen. Preferably, the control and/or monitoring systems and/or programs of the invention function in real time.

For example, information received from the sensors is received and interpreted in real time. In other words, inconsistencies or deviations from threshold parameters are detected in the range of seconds, preferably within less than a second, less than 0.1 seconds, more preferably less than 0.01 second, even more preferably within less than 10 milliseconds, in particular within 1 milliseconds.

According to an embodiment, the device of the invention comprises a plurality of sensors 59, 60, 61, 62, 63 sending information to a data processing unit 200 to provide a monitoring of the device of the invention.

The linear encoders 61 and 62 provide information with respect the position of the first and second carts 21, 22, respectively on their respective rails tracks. Information with respect to the position of said first and second carts is also provided by the first and second shaft encoders 71, 72, respectively. The information produced by linear encoders 61, 62 and shaft encoders 71, 72 is thus redundant. The data processing unit 200 preferably runs a program, which compares the data from linear encoder 61 with the redundant data received from shaft encoder 71 and/or the data from linear encoder 62 with the redundant data received from shaft encoder 72. Of course, it is not relevant which data is considered to be redundant, as the data of shaft encoder 71 is redundant with the data of linear encoder 61 and vice versa.

If the data processing unit 200 detects any determined inconsistency and/or deviation when comparing the redundant data received, a correction or termination program is preferably triggered.

Preferably, the data processing unit 200 receives redundant information regarding the position of first and second carts 21 and 22 in real time and/or within a very short time delay following sending the instructions to the first and second motors 41 and 42. In this manner, regarding the security, the real time monitoring system of the invention is provided.

The angle sensor 63, measuring angle $\gamma$ in FIG. 19, may produces position-related data that is also redundant, in differential values and/or terms, with respect to linear encoders 61 and 62 and/or shaft encoders 71 and 72. Angle sensor 63 determines the angle between subassemblies 5 and 6, in other words, the two arms of the $\lambda$-framework. In other words, the positions of the carts 21, 22 on their respective rail track determine the angle $\alpha$ (FIG. 19).

In particular, as can be seen from FIGS. 21, P2 and P3 are known, which is why the angle $\gamma$ corresponds to a relative position of cart 21 with respect to cart 22, or to a determined distance between the two cars. The angle $\gamma$ can be calculated from the positions of the carts and from further information that is known (length of subassembly 6, etc). Angle $\gamma$ also determines angle $\alpha$ in FIG. 19, which can be calculated from the positions of the driving carts.

Accordingly, the angle sensor 63 produces information related to the differential position of the driving carts 21 and 22, and thereby provides further redundant information concerning the position of the driving carts. The data processing unit 200 further compares the data of angle sensor 63 with the data received from either liner encoders 61 and 62 and/or with data received from shaft encoders 71 and 72. Again, redundant data are compared in real time in a monitoring control system and the emergency program is activated upon detection of inconsistencies between redundant data.

A further redundancy feature concerns the position of the foot contact assembly 4. The angle $\phi$ (FIG. 19) of the foot contact assembly or pedal 4 with respect to ground or with respect to the main framework subassembly 5 or with respect to a structural component of the latter is determined in several ways. First, the angle sensor 59 (FIG. 19) determines the angle $\phi$.

Angle $\phi$ can also be retrieved or determined from data produced by the encoder 106, which can also include or comprise a shaft or rotary encoder 106. The shaft encoder 106 thus provides information, which can be translated to a parameter, such as the angle, which can then be compared with the other data concerning the same parameter.

In an embodiment, the device of the invention comprises a data processing unit 200, which is programmed to compare redundant data related to an angular position of said foot contact assembly 4 and/or of said Tool Operating Center (TOC) 4 of the device, and to start a correction or a termination program in case the data processing unit 200 detects a determined inconsistency between the redundant data.

The data processing unit 200 compares data received from angle sensor 59 with data from the shaft encoder 106, preferably within a very short time delay (e.g. in real time) following sending the instructions to the third motors 43, more preferably in real-time, thereby providing said a monitoring. In case of inconsistency, a correction or termination procedure is triggered, as described elsewhere in this specification. As the data processing unit 200 sends instructions to the third motor driver 43, the data of sensor 59 and/or of encoder 106 can be compared to the instructions sent previously to the motor.

A further redundancy feature concerns the current intensity of the motors 41, 42 and 43 and the information produced by the force and/or torque sensor 60, measuring the load, in particular the force and/or torque applied on the foot contact assembly and/or TOC 4. The force and/or torque measured by sensor 60 is thus redundant with the current intensity of the motors.

In an embodiment, the data processing unit 200 compares data received from the force and/or torque sensor 60 with data concerning the current intensity of the motors. As described elsewhere in this specification, the information concerning the current intensity is part of the data that the motor drivers 211, 212 and 213 to the computer 200.

When comparing redundant information and/or data, the data processing unit 200 checks if there are inconsistencies between comparable parameters and if these inconsistencies reach or exceed a specific threshold value. If the threshold value is reached, the termination computer procedure is run.

In the embodiment, the device of the invention comprises electronic stoppers 208, 209 and 208', 209'. An electronic stopper is preferably provided at the extremity and/or end of each rail track section 11/12 and 13/14, respectively. For example, at the two extremities of rail track section 11/12, electronic stoppers 208 and 209 are provided, respectively. The electronic stoppers/encoders of the second pair of rails 13, 14 and the second drive screw 32 are indicated with reference numerals 208' and 209'. The electronic stoppers may be fixed on the support structure 68 for the rails (FIG. 4), for example, close to the extremities of the rails/driving screw. Preferably, the electronic stoppers comprise and/or are sensors, preferably inductive sensors. The sensors 208, 209 and 208', 209' preferably produce a signal when a driving cart is close to the extremity of the respective rail track section. If the presence of the sliding carts 21 and 22 is sensed by a sensor 208, 209 and 208', 209', respectively, a termination program is preferably run to stop the device. The presence of a driving cart close to an extremity of a rail track section represents an anomaly, because the movements of the ASs of the invention are preferably enabled without the driving cart getting to the extremities of the respective rail track section.

In the embodiment shown in FIG. 19, the data produced by the electronic stoppers 208, 208' and 209, 209' is transmitted to I/O device 207, via cable.

In another, alternative embodiment, the data produced by the electronic stoppers is transmitted to the motor drivers, such as to 211, 212 and/or 213. The drivers may directly brake the motors down following receipt of a signal from any one or more of the electronic stoppers, indicating the presence of a cart at the end point of a rail track. According to a still other embodiment, the data produced by the electronic stoppers is transmitted directly to the computer 200.

In FIG. 19, an I/O device 207 can be seen. This device 207 can be regarded as part of a data processing assembly 200/207. According to an embodiment, the I/O device 207 receives redundant signals from one or more sensors and captors of the device. Preferably, the I/O device 207 transmits signals received from the sensors to the computer 200, and/or transforms the signals to a format that is understood by the computer.

As has been described above with reference to FIG. 19, the device of the invention comprises a real time, closed loop system for controlling and/or driving the movement of the ASs, in particular of the TOC within the degrees of freedom provided. In addition, the movement of the ASs and/or TOC 4 is monitored in real time on the basis of multiple redundant data, so as to assure the proper and safe operation of the device of the invention. In case of any type of inconsistency, anomaly or other indication of a potential danger to the subject using the device, the device is braked down.

Figure 20:
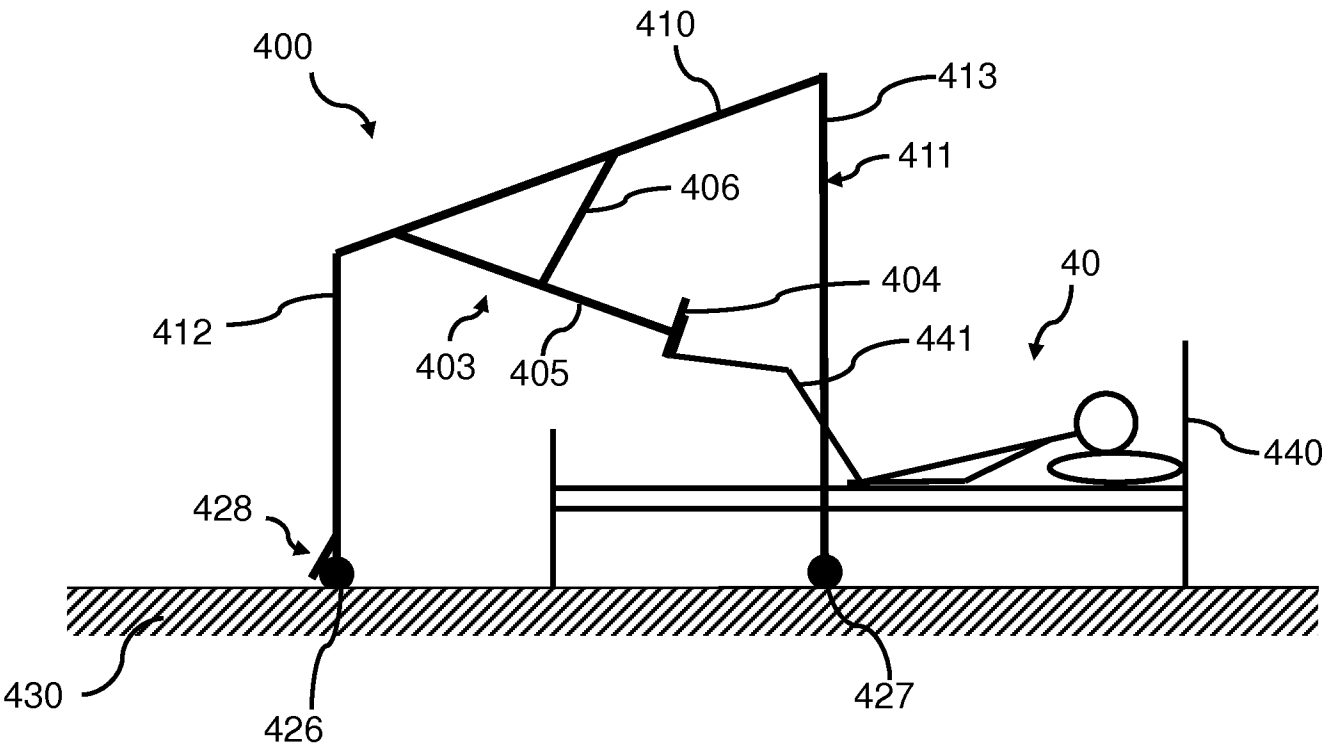
FIG. 20 is a schematic representation of another embodiment of the device of the invention.

For using the device of the invention, the feet of a subject are attached to the left and right foot contact areas 904, 4. Depending on the orientation of the ASs 9, 900, the subject takes place in a seat in front of the device, on a bed or in any applicable position (FIG. 20). If the ASs are vertical as shown in FIGS. 1 and 17-18, the subject is placed in a seat (not shown). The height of the seat from ground and the distance from the ASs is adjusted in dependence of biometric information concerning the subject, in particular biometric information concerning body size, leg length, and so forth. This information is requested by an interface and/or computer program and has to be entered along with more detailed information required for running any specific training session, as described below. Once the subject is well placed in relation to the ASs, and once further stabilization in particular of the legs has taken place, if required, a training program can be started.

Stabilization of the legs or articulations of the subject is conducted by way of external splints possibly comprising articulations. Since the device of the invention lacks an exoskeleton for stabilizing the limbs of the subject, such external stabilizers (exoskeleton, splints, etc) are preferably used for stabilizing or guiding the movement of the lower limbs during exercising. This applies in particular to subjects that cannot control their lower limbs, such as para- or tetraplegic patients, for example.

Detailed information regarding the subject has to be available to the computer before any exercise can be started. This detailed information comprises detailed biometric data of the subject, such as the positions or distances between the articulations, in particular between the hip, knee and ankle articulations. Biometric data concerning the size, weight, age, sex of the subject is collected, as well as any information regarding a possible handicap, such as paralysis, or also regarding constraints with respect to the degrees of freedom of the movement of the subject. This information determines the extent or distances run by the ASs once an exercise starts.

The device of the invention is destined to different types of users and/or subjects. For the purpose of this specification, the term "subject" is used for an individual that can use or that uses the device of the invention. The device of the invention can be operated as a wellness device for healthy subjects and/or elderly subjects, for example. The device of the invention can be used for wellness purposes in general.

According to an embodiment, the device of the invention is suitable to re-educate or train the lower limbs of subjects having an impairment of the central nervous system, such as a subject suffering from tetraplegia, paraplegia or hemiplegia, subjects suffering from muscular atrophy, geriatric subjects, subjects suffering from traumatic injuries of the lower limbs, multiple trauma patients, subjects that have undergone surgery, for example of the hips or lower limbs, in particular subjects having undergone surgery to receive a prosthesis, subjects having received a prosthesis, such as an artificial limb or joint, such as an artificial hip or knee, for example.

The device of the invention is suitable to re-educate subjects suffering from bone fracture, injuries of the ligaments (torn or overstretched), and/or subjects suffering from multiple trauma.

The device is thus not limited to being used by subjects that are totally or partially paralyzed (e.g. patient suffering from paraplegia), but also subjects that are not suffering from paraplegia. For example, the device can be used for training patients that need exercising of the lower limbs for any reason, including non-medical reasons.

The device of the invention can be run in different modes. In a first mode the subject is passive, and the movements are substantially controlled by the device. In this case, the movements, including movement speed, of the ASs are entirely determined by the device and/or the computer. The muscles of the subject to not contribute to the movement of the ASs in this mode, or, in other words, the ASs have to be moved against resistance due to gravity of the device itself and due to the limbs of the subject fixed on the device. The exercises in this mode will be run by paraplegic or tetraplegia patients, for example. In another mode, the motors only guide the movement, but muscular efforts by the subject are required to make the ASs move. The motors may provide a controlled resistance to the movement of the ASs. In this type of mode, the patient trains his/her muscles actively, by own activity. This type of exercise is suitable, of course, for patients that are still able to control, even a little and/or not totally, the movement of their lower limbs.

As the skilled person will understand, the ASs of the invention are constructed to allow any type of movement and/or exercise within the sagittal plane in which the ASs are situated. The device has three degrees of freedom, of which two concern the position in an sagittal (vertical) plane, and the third the angular position of the foot contact assembly 4.

Circular movements as well as linear movements and movements comprising a combination of linear or curved parts can be conducted. Just to mention a few examples, a typical exercise is "cycling". In this exercise, the foot contact area 4 is moved by the λ-framework so as to conduct circular movements, and the left and right ASs are offset by 180° degrees (half a circle), as is the case with the pedals of a bicycle. Of course, the pedal 4 also performs a defined, regular angular movement in addition to the circular, so as to take the ankle movement of the subject into account.

Another type of exercise is the "press-leg" or the leg part of the rowing movement. In this exercise, the pedal 4 is moved back and forth by λ-framework along a straight line. Of course, the pedal 4 also performs a defined, regular angular movement in addition to the linear, straight line-movement, so as to take the ankle movement of the subject into account. In this exercise, both ASs 9, 900 will move substantially synchronously, unless the anatomy of the subject requires an offset movement, for example, or an independent, non-synchronous movement.

Besides these two types of exemplary exercises, the device of the invention can be programmed to conduct a nearly indefinite number of movements and exercising in which the two ASs conduct any determined movement, synchronously or independently.

The control system of the device of the invention comprises memories for stocking the data associated with a subject, such as the biometric date set out above. Furthermore, the control system of the invention is preferably capable of storing data produced during an exercise. These data include the length, numbers of repetition of the exercise. Furthermore, regarding a specific exercise, all data are stored immediately in the memory of the device. This includes data received from the sensors recoded during the exercise. The exercise can be analysed in real time (in the course of the exercise) or after the exercise by a medically trained person and/or an assistant. Forces exerted by the subject during the exercises and torques measured by force and/or torque sensor 60 are recorded and can be analysed. In this manner, it is also possible to detect spasms that occurred during an exercise and to check in what position/movement such spasms occurred, for example. In this way, the exercise can be adapted to the needs and capacities of the subject and/or patient using the device.

The present invention encompasses serious games for the purpose of training and/or exercising. In accordance with an embodiment, the device of the invention preferably comprises at least one output unit producing serious games and/or a virtual or extended environment or reality for the subject. For example, serious games and/or the virtual reality can be a visual or optical games and/or reality, displayed on a screen and/or on head-mounted displays in the form of glasses or a helmet, for example. The serious game and/or virtual reality may comprise or essentially consist of an audible game and/or reality. According to an embodiment, the serious game and/or virtual reality is an audio-visual game and/or reality. In accordance with an embodiment, the serious game and/or virtual reality is related to a specific exercise. For example, in case of a cycling exercise, the virtual reality may comprise a visual reality of cycling, for example in a cycling tour and/or on a track. The bicycle and/or parts thereof may be part of the virtual reality produced by a computer program and/or the computer 200. As another example, in case of a rowing exercise, the virtual reality may exhibit a water body, and/or a rowing boat and/or parts thereof. The serious games and/or virtual reality may simulate a competitive environment, with competing bicycles and/or rowing boats as applicable, for example. Preferably, the serious game and/or virtual reality is adapted to, related to, tuned with or timed with a specific type of exercises. In this regard, characteristics of an exercise are related to events taking place in the serious game and/or the virtual reality. Or, the other way round, the serious game and/or virtual reality is tuned with characteristics of the exercise. For example, in the cycling environment, if there is an ascending slope, the ASs and/or TOCs conduct the cycling movement more slowly, the latter being an example of a characteristic of the exercise as programmed. On the other hand, when there is a decreasing slope, the ASs and/or TOCs move more rapidly and the background of the virtual passes by more quickly. The virtual reality may produce obstacles, associated with and/or corresponding to changes in the regular movement of the ASs at the same time. The obstacle is thus a characteristic of the virtual reality, related to the characteristic of the irregular movement of the ASs, as determined by the program running the motor drivers. Of course, one can envisage different games that can accompany the various exercises that can be conducted by the device of the invention. The games are preferably run by a computer and/or data processing machine 200 and produce a virtual reality related to a given exercise. Of course, it is much more entertaining and/or motivating to exercise in the environment of a virtual reality. The present invention allows thus combining useful or even necessary training with a playful and/or funny environment, in particular with a virtual environment. This combination is preferably controlled by the computer or control system 200.

In accordance with an embodiment, said control system 200 comprises an output unit for producing serious game and/or a virtual reality, wherein said output unit is arranged to exhibit the serious game and/or virtual reality to a subject of the device during an exercise, wherein said serious game and/or virtual reality is related to, tuned with and/or timed with characteristics of the exercise. Preferably, the serious game and/or virtual reality is related to, tuned with and/or timed with movements of the ASs and/or TOCs.

FIG. 20 schematically shows another embodiment 400 of the device of the invention in use. The device 400 is mobile and adapted to be used by a subject and/or patient 40 in a bed 440. In the device 400, the λ-framework 403 is oriented in an upside-down position, in which the longitudinal subassemblies 405 and 406 extend in a top-down orientation. The λ-framework 403 is fixed on the bottom side of an inclined support structure 410. The support structure 410 could also be horizontal instead of being at an angle. The support structure is part of an overall support framework or carrying system 411, which is based on four pillars or vertical support profiles. On the bottom of the pillars 412, 413 there may be wheels 426, 427, which allow the movement of the device 400 on a ground or floor surface 430. Due to the schematic, two-dimensional side elevation view of FIG. 20, only the rear and front pillars 412, 413, and the rear and front wheels 426, 427, respectively, of one side of the device 400 are shown. Only one λ-framework 403 is shown and only one leg 441 of the subject in contact with the foot support assembly 404 and/or TOC of the AS. The wheels 426, 427 of the device can be blocked by way of one or more blocking devices 428, which act on the wheels. The advantage of a carrying system 411 for the ASs of the invention is that the entire device is movable and can be brought into a position of use and/or exercising without the subject having to leave his bed. This is advantageous in cases where a subject cannot easily leave his bed due to his/her condition.

REFERENCE NUMERALS

1 device
2 base
3 lambda framework
4 foot support assembly
5 main (λ-framework) subassembly
6 support (λ-framework) subassembly
7 first cart articulation
8 second cart articulation
9 left articulated system (AS) (900: right AS)
10 support or carrier structure
11 rail (of first pair of rail)
12 rail (of first pair rail)
13 rail (second pair of rail)
14 rail (second pair of rail)
15, 15' first inner threading holding piece; first nut of first and second pair of rail, resp.
16, 16' 2nd inner threading holding piece; 2nd nut (of first and second pair of rail, resp.)
18 blocking device/flange
20 transmission assembly
21 first cart
22 second cart
23, 23' Pair of belt pulleys 1
24, 24' Pair of belt pulleys 2
25, 25' Pair of belt pulleys 3
26, 26' Pair of belt pulleys 4
27 driving belt 1
28 driving belt 2
29 driving belt 3
30 Longitudinal subassembly
31 first driving screw
32 second driving screw
33 driving belt 4
34 driving belt 5
35 web of H-beam
37 Axis of pair of pulleys 23, 23'
38 Axis of pair of pulleys 24, 24'
39 Axis of pair of pulleys 25, 25'
40 subject/patient
41 First motor
42 second motor
43 third motor
44 foot support carrying assembly
45 Axis of pair of pulleys 26, 26'
47 belt pulley of foot support surface assembly 44
48 first side of web 35
49 second side of web
50 Connection subassembly
51 bearing assembly
52 contact plate/area for foot
53 first lateral carrier plate
55 second lateral carrier plate
55 first pivoting axle of foot support
56 second pivoting axle of foot support
57 first bearing of foot contact assembly
58 second bearing foot contact assembly
59 angle sensor (first; foot assembly angle sensor))
60 force/torque sensor (preferably a 6 axis force/torque sensor)
61 first linear encoder
62 second linear encoder
63 angle sensor (second; λ-angle sensor)
64 first protective cover
65 second protective cover
66 bar of support assembly
66' bar of support assembly
67 cart axle of support framework assembly
68 support structure for rails
69 ball bearing holding piece for driving screw 31
69' ball bearing holding piece for driving screw 31
70 L-piece
70' L-piece
71 first shaft or rotary encoder
72 second shaft or rotary encoder
73 third shaft or rotary encoder
74 stopper end of rail 11
74' stopper end of rail 11
75 stopper end of rail 12
75' stopper end of rail 12
76 shaft of driving screw 31
77 pulley of first driving screw
78 belt for pulley of first driving screw
79 carrying structure (e.g. H-beam)

80, 80' protective covers, dust scrapers
81 chassis of first cart 21
82, 82' sliders
83 platform
84 mount (plate) for first articulation 7
84' mount (plate) for first articulation 7
85 first articulation axle
86 mount for third motor 43
87 gearing of third motor 43
88, 88' wings of chassis 81
89 hole in chassis 81
91 head or flange of nut 15
92 head or flange of nut 16
93 hollow cylindrical section of nut 15
94 hollow cylindrical section of nut 16
95 abutment surface of nut 15
96 abutment surface of nut 16
97, 97', 97" screws for fixing second nut 16
98, 98', 98", 98'" screws for fixing blocking device/clamp 18
99 cut out of clamp 18
100 radial bore on flange 91
101 holding piece for linear encoder 61
102, 102' magnetic strip
103 pivot axle between main and support subassemblies 5 and 6
103', 103" separate partial axles forming axle 103
104 motor pulley
105, 105' plates of connection subassembly 50
106 decoder
107 tubular axle for the first pair of belt pulleys 23, 23'
108 support piece for foot contact plate 52
109 ball bearing of bearing assembly 51
110 carrying system/verticalisation system
111 steel frame
112 front side
113 flexible duct for electric cables
114 right lateral side of carrying system
115 backside of carrying system
116, 116' doors in cabinet of carrying system 110
117 lateral support
117' raker of lateral support
117" horizontal bar of lateral support
117'" vertical bar of lateral support
118 lateral support
119 lateral support
120 cabinet
121 lateral support
122, 122' vertical profile
123, 123' vertical profile
124, 124' horizontal profile
125, 125' horizontal profile
126 adjustment assembly
127 floor contact piece
128 lateral border of flat piece 52
200 data processing unit
203 interface for operator (input, e.g. keyboard)
204 interface for operator (output, e.g. screen)
205 Human Machine Interface
206 Real Time (RT) computing unit
207 Intermediate I/O device (e.g. L etherCAT I/O)
208, 208' first electronic stopper
209, 209' second electronic stopper
211 first motor driver
212 second motor driver
213 third motor driver
214 electronic power source (e.g. 24 Volt)
215 electronic power source (e.g. 230 Volt)
216 transformers
217 circuit breakers
218 data bus
900 right articulated system (AS)

The invention claimed is:

1. A motorized device for training the lower limbs of a subject, the device comprising a pair of articulated systems (ASs), intended to form an interface with said subject, wherein each of said articulated systems comprises a base, a foot support assembly and a framework for said foot support assembly, wherein:

said framework comprises two longitudinal, articulated subassemblies, a main subassembly and a supporting subassembly, wherein, at one extremity, said main subassembly is pivotally connected to a first cart articulation, and wherein said foot support assembly is pivotally connected at another, free extremity of said main subassembly, wherein said supporting subassembly is pivotally connected at one extremity to a second cart articulation and with another extremity to said main subassembly;

said base comprises a support or carrier structure on which two rail track sections, a first rail track section and a second rail track section, are fixed, wherein a first cart is guided on said first rail track section and a second cart is guided on said second rail track section;

said base further comprises a first driving screw and a second driving screw, wherein said first driving screw is arranged to drive said first cart and said second driving screw is arranged to drive said second cart;

a first motor is arranged to rotate said first driving screw and a second motor is arranged to rotate said second driving screw, wherein rotation of said first and second driving screws results in linear movement of said first and second cart, respectively; wherein said motorized device further comprises:

a third motor acting on a transmission assembly, wherein said transmission assembly is adapted to transmit a rotational movement of said third motor to said foot support assembly, wherein said foot support assembly is pivotally connected to said main subassembly, wherein said third motor is directly mounted, or directly mounted via a motor mount, on said first cart and in that said transmission assembly comprises a plurality of pairs of co-rotational belt pulleys, and a plurality of driving belts acting on said belt pulleys, wherein a rotational movement from said third motor on said first cart propels the rotation of a motor pulley, and wherein rotation of said motor pulley is transmitted via a first belt to a first pair of pulleys of said transmission assembly.

2. The device of claim 1, wherein said first cart and said second cart each comprises a pair of inner threading holding pieces, each pair comprising a first inner threading holding piece and a second inner threading holding piece, wherein said first and second driving screws, independently, are threadedly engaged with said pair of inner threading holding pieces, wherein said first and second inner threading holding pieces are rotationally blocked and/or blockable, and wherein rotation of said first or second driving screw results in a translational movement of the respective first or second cart, wherein said first and second inner threading holding pieces are independently fixed on said respective cart.

3. The device of claim 2, wherein said first and second inner threading holding pieces comprise inner threads, and wherein a relative rotational position of said inner threads of said first and second inner threading holding pieces is configured to be adjusted by independently fixing said inner threading holding pieces on said cart, and wherein adjustment of said relative rotational position results in a reduction or increase of a play between said pair of inner threading holding pieces and said driving screw.

4. The device of claim 2, wherein said first and second carts each comprise a blocking device configured to block the first inner threading holding piece at an adjusted and/or desired position on said cart and/or on a chassis of said cart.

5. The device of claim 1, wherein said first pair of belt pulleys are coaxial with an axle of the first cart articulation.

6. The device of claim 1, wherein said foot support assembly comprises a force sensor arranged to measure the force applied by a foot put on said foot support assembly and/or on a foot contact plate.

7. The device of claim 6, wherein said force sensor is a 6 -axis force and torque sensor.

8. The device of claim 1, comprising an angle sensor configured to measure an angle ($\phi$) of said foot contact assembly with respect to the main subassembly or with respect to a structural element rigidly connected to said main subassembly.

9. The device of claim 1, comprising an angle sensor configured to measure an angle ($\gamma$) between said main and support subassemblies.

10. The device of claim 1, further comprising a control system and/or data processing unit configured to control the device.

11. The device of claim 10, comprising a data processing unit arranged to receive information originating from a first linear encoder, a second linear encoder, and/or a force sensor.

12. The device of claim 10, comprising a data processing unit arranged to receive input originating independently from a first shaft encoder, a second shaft encoder, and/or a force sensor.

13. The device of claim 10, wherein said data processing unit comprises an output unit configured to produce a virtual reality, wherein said output unit is arranged to exhibit the virtual reality to a subject of the device during an exercise, wherein said virtual reality is related to, tuned with and/or timed with characteristics of the exercise.

14. The device of claim 1, wherein a first and a second linear encoder are provided on said first and second carts, respectively, and wherein a position of said first and second carts on their respective rail track section is calculable from measurements of said first and second linear encoders.

15. The device of claim 1, comprising a first and a second shaft encoder, capable of measuring rotation of an axle propelled by said first and second motors, wherein a position of said first and second carts on their respective rail track section is calculable from measurements of said first and second shaft encoders.

16. The device of claim 1, comprising a control system comprising a Human Machine Interface (HMI) and a Real Time (RT) computing unit.

17. The device of claim 1, wherein a data processing unit is provided, wherein said data processing unit is programmed to compare redundant data related to a position of said first and/or second carts and/or to a position of a Tool Operating Center (TOC) of the device, and to start one or more selected from a correction or a termination program in case the data processing unit detects a determined inconsistency between the redundant data.

18. The device of claim 1, which comprises a data processing unit, which is programmed to compare redundant data related to an angular position of said foot contact assembly and/or of a Tool Operating Center (TOC) of the device, and to start a safety or termination program in case the data processing unit detects a determined inconsistency between the redundant data.

19. The device of claim 18, wherein said redundant data concerning the angular position of the foot contact assembly and/or TOC is produced by an angle sensor and by a shaft encoder.

20. A carrying system comprising the motorized device of claim 1, the carrying system comprising an inclined or horizontal support structure, wherein the articulated systems of said motorized device are positioned and/or fixed up-side down and/or on a bottom side of said inclined or horizontal support structure.

* * * * *